US007765917B2

(12) United States Patent
Hardin et al.

(10) Patent No.: US 7,765,917 B2
(45) Date of Patent: Aug. 3, 2010

(54) AIR COMPRESSOR

(75) Inventors: John W. Hardin, Medina, TN (US); Mark W. Wood, Jackson, TN (US); John R. Bezold, Jackson, TN (US); Lance S. Hathcock, Jackson, TN (US)

(73) Assignee: Black & Decker Inc., Newark, DE (US)

( * ) Notice: Subject to any disclaimer, the term of this patent is extended or adjusted under 35 U.S.C. 154(b) by 402 days.

(21) Appl. No.: 11/960,859

(22) Filed: Dec. 20, 2007

(65) Prior Publication Data

US 2008/0168898 A1 Jul. 17, 2008

Related U.S. Application Data

(60) Provisional application No. 60/880,472, filed on Jan. 12, 2007.

(51) Int. Cl.
*F04B 35/04* (2006.01)
*F04B 17/00* (2006.01)

(52) U.S. Cl. ..... 92/153; 92/171.1; 417/415

(58) Field of Classification Search ..... 92/73, 92/147, 151, 171.1; 415/415
See application file for complete search history.

(56) References Cited

U.S. PATENT DOCUMENTS

| | | | | |
|---|---|---|---|---|
| 217,965 | A | 7/1879 | Waring | |
| 1,687,395 | A * | 10/1928 | Shew | 184/13.1 |
| 1,801,395 | A * | 4/1931 | Summers | 92/171.1 |
| 1,939,057 | A | 12/1933 | Kercher | |
| 2,151,698 | A | 3/1939 | Harper, Jr. | |
| 2,628,765 | A * | 2/1953 | Anderson | 92/73 |
| 2,944,534 | A | 7/1960 | Hodkin | |
| 3,672,263 | A | 6/1972 | Mirjanic | |
| 4,097,202 | A | 6/1978 | Price | |
| 4,393,752 | A | 7/1983 | Meier | |
| 4,667,635 | A | 5/1987 | Lichtblau | |
| 4,802,826 | A | 2/1989 | Hall | |
| 5,118,263 | A | 6/1992 | Fritchman | |
| 5,694,780 | A | 12/1997 | Alsenz | |
| 5,775,885 | A | 7/1998 | Dreiman et al. | |
| 5,971,717 | A | 10/1999 | Berthold | |
| 6,692,205 | B2 | 2/2004 | Moroi et al. | |

(Continued)

FOREIGN PATENT DOCUMENTS

| | | | |
|---|---|---|---|
| DE | 409617 | C | 2/1925 |

(Continued)

*Primary Examiner*—Thomas E Lazo
(74) *Attorney, Agent, or Firm*—Harness, Dickey & Pierce, P.L.C.

(57) ABSTRACT

An air compressor that employs splash lubrication to lubricate and cool a piston kit that includes a cylinder and a piston reciprocating in the cylinder. In one form, cooling channels can be coupled to or formed on the cylinder to direct the lubricant that is splashed onto the cylinder to drain in a desired manner, such as helically around the exterior of the cylinder, to more effectively cool the piston kit. In another form, the cylinder can include an annular flange that can be bigger in diameter than a remainder of the cylinder. The annular flange can be received into a counterbore in a cylinder block. A cylinder head, which can be fastened to the cylinder block, can apply a clamping force to the annular flange to clamp or fix the cylinder to cylinder.

30 Claims, 15 Drawing Sheets

U.S. PATENT DOCUMENTS

| | | | | |
|---|---|---|---|---|
| 6,742,995 | B1 | 6/2004 | Wood et al. | |
| 6,923,627 | B1 | 8/2005 | Wood et al. | |
| D516,090 | S | 2/2006 | Gist et al. | |
| D516,091 | S | 2/2006 | Leasure et al. | |
| D517,092 | S | 3/2006 | Leasure et al. | |
| 7,025,573 | B1 | 4/2006 | Hardin et al. | |
| D559,272 | S | 1/2008 | Buck et al. | |
| D574,020 | S | 7/2008 | Buck et al. | |
| 7,413,414 | B2 | 8/2008 | Wood et al. | |
| 7,458,784 | B2 | 12/2008 | Vos et al. | |
| 2003/0159888 | A1* | 8/2003 | Burkholder | 184/11.1 |
| 2004/0197200 | A1 | 10/2004 | Wood et al. | |
| 2005/0175475 | A1 | 8/2005 | Baron | |
| 2006/0065309 | A1 | 3/2006 | Leasure et al. | |
| 2006/0104837 | A1 | 5/2006 | Lee et al. | |
| 2006/0219811 | A1 | 10/2006 | Woods | |
| 2008/0044296 | A1 | 2/2008 | Wood et al. | |
| 2008/0168898 | A1 | 7/2008 | Hardin et al. | |
| 2009/0016902 | A1 | 1/2009 | Lee et al. | |
| 2009/0053076 | A1 | 2/2009 | Vos et al. | |

FOREIGN PATENT DOCUMENTS

| | | | |
|---|---|---|---|
| DE | 577185 | C | 5/1933 |
| DE | 1234095 | B | 2/1967 |
| DE | 1576407 | A1 | 5/1970 |
| DE | 1916096 | A1 | 10/1970 |
| DE | 3006332 | A1 | 8/1981 |
| DE | 10214307 | A1 | 10/2003 |
| DE | 10225062 | A1 | 1/2004 |
| DE | 10338979 | A1 | 3/2005 |
| EP | 182324 | A2 | 5/1986 |
| EP | 0206184 | A2 | 12/1986 |
| EP | 1957796 | A1 | 8/2008 |
| GB | 658118 | A | 10/1951 |
| GB | 2000223 | A | 1/1979 |

* cited by examiner

AIR COMPRESSOR

CROSS-REFERENCE TO RELATED APPLICATIONS

This application claims the benefit of U.S. Provisional Patent Application Ser. No. 60/880,472 filed Jan. 12, 2007, the disclosure of which is hereby incorporated by reference as if fully set forth in detail herein.

INTRODUCTION

The present invention generally relates to air compressor systems and more particularly to improvements in air compressor systems that permit an air compressor system to be manufactured with lower cost and increased robustness.

Air compressor systems having one or more reciprocating pistons that provide single-stage air compression can be relatively inexpensive, lightweight and durable in light to medium duty applications and as such, this type of air compressor system is relatively popular across a diverse span of professional and recreational users. As the users of air compressor systems become more sophisticated and as the number of pneumatically-powered accessories increases and their cost decreases, there is increasing interest in air compressor systems that are capable of producing higher output pressures. The cost of the available higher-pressure air compressor systems, particularly those involving two-stage compression or other types of compression (e.g., scroll compressors) tends to be relatively higher than the cost of a single-stage air compressor system and as such, can tend to dampen consumer enthusiasm for higher-pressure air compressor systems.

Accordingly, it would be advantageous to provide an air compressor system that employs single-stage compression but which is relatively low cost to manufacture, operate and maintain and which is relatively robust. Those of skill in the art will appreciate that the teachings of the present disclosure have application to diverse types of air compressor systems and as such, will appreciate that the present disclosure is not necessarily limited to reciprocating piston-type compressors or compressors that are capable of outputting relatively high pressure compressed air.

SUMMARY

In one form, the present teachings provide an air compressor assembly with a cylinder block group, a crankshaft, a piston kit group and a member associated with the crankshaft. The cylinder block group has a head deck and defines an internal cavity. At least a portion of the interior cavity forms a sump that is configured to receive a lubricant such that the lubricant is disposed below a liquid lubricant fill level. The crankshaft is rotatably disposed in the interior cavity. The piston kit group has a cylinder and a piston kit. The cylinder is received through the head deck and defines a piston bore. At least one cooling channel is formed about an exterior surface of the cylinder. The piston kit includes a piston, a wrist pin and a connecting rod. The piston is slidably received in the piston bore. The wrist pin connects the piston to a first end of the connecting rod and a second end of the connecting rod is coupled to the crankshaft. The member moves in the sump such that at least a portion of the member crosses the liquid lubricant fill level as the crankshaft rotates. The member is adapted to sling the lubricant outwardly from the sump such that a first portion of the slung lubricant collects on at least one of the piston bore and the piston to lubricate an interface between the piston and the cylinder and a second portion of the slung lubricant collects in the at least one cooling channel and moves at least partially around the exterior surface of the cylinder in response to gravitational force exerted thereon to thereby draw heat from the cylinder. The air compressor assembly does not include a lubricant pump for pumping the lubricant to lubricate the piston group and the crankshaft.

In another form, the present teachings provide air compressor assembly with a cylinder block group, a crankshaft, a lubricant, a piston kit and a member associated with the crankshaft. The cylinder block group has a head deck and defines an internal cavity. At least a portion of the interior cavity forms a sump. The crankshaft is rotatably disposed in the interior cavity and the lubricant is disposed in the sump. The piston kit group has a cylinder and a piston kit. The cylinder is received through the head deck and defines a piston bore. The piston kit includes a piston, a wrist pin and a connecting rod. The piston is slidably received in the piston bore. The wrist pin connects the piston to a first end of the connecting rod and a second end of the connecting rod is coupled to the crankshaft. The member is associated with the crankshaft and moves through the lubricant in the sump to thereby sling the lubricant outwardly from the sump such that a first portion of the slung lubricant collects on at least one of the piston bore and the piston to lubricate an interface between the piston and the cylinder and a second portion of the slung lubricant draws heat from the cylinder from a surface other than the piston bore. The cylinder is configured to collect the second portion of the slung lubricant and control the flow of the second portion of the slung lubricant as it drains back to the sump.

In another form, the present teachings provide a method for rejecting heat from an air compressor that includes comprising a cylinder block group, a crankshaft, a lubricant and a piston kit. The cylinder block group has a head deck and defining an internal cavity and at least a portion of the interior cavity forms a sump. The crankshaft is rotatably disposed in the interior cavity. The lubricant is disposed in the sump. The piston kit group has a cylinder and a piston kit. The cylinder is received through the head deck and defines a piston bore. The piston kit includes a piston, a wrist pin and a connecting rod. The piston is slidably received in the piston bore. The wrist pin connects the piston to a first end of the connecting rod and a second end of the connecting rod is coupled to the crankshaft. The method includes: rotating the crankshaft to reciprocate the piston in the cylinder to alternately intake air into the cylinder and compress the air, wherein rotation of the crankshaft moves a member associated with the crankshaft through the lubricant in the sump such that the member slings lubricant outwardly; discharging the compressed air from the cylinder; collecting a portion of the slung lubricant on an exterior surface of the cylinder; and directing the collected portion of the slung lubricant to flow about the exterior surface in a predetermined manner to permit heat to be rejected from the cylinder to the collected portion of the slung lubricant.

In yet another form, the present teachings provide an air compressor assembly with a crankcase, a crankshaft, a lubricant, a compression cylinder, a piston kit, and a head assembly. The crankcase includes a head deck and defines an internal cavity. At least a portion of the interior cavity forms a sump. The crankshaft is rotatably disposed in the interior cavity and the lubricant is disposed in the sump. The compression cylinder includes an exterior surface principally surrounded by the internal cavity and an inner surface defining a piston bore. The piston kit includes a piston, a wrist pin and a connecting rod. The piston is slidably received in the piston bore. The wrist pin connects the piston to a first end of the connecting rod and a second end of the connecting rod is coupled to the crankshaft. The head assembly is coupled to the crankcase and includes an outlet valve. The piston reciprocates in the cylinder to compress air that is disposed between the compression cylinder, the piston and the head assembly and wherein the valve opens to release compressed air in the compression cylinder when a pressure of the compressed air in the compression cylinder exceeds a predetermined pressure.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION OF THE VARIOUS EMBODIMENTS

Figure 1:
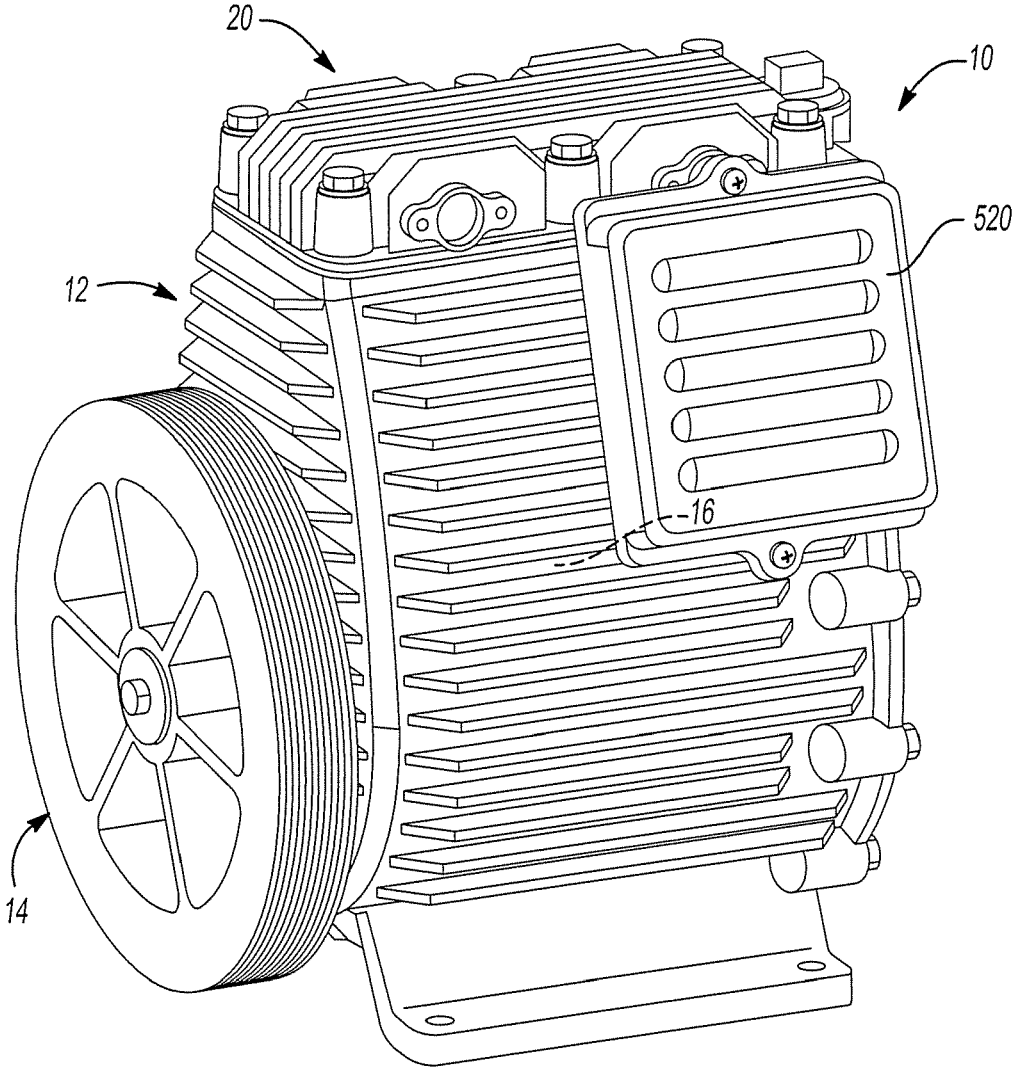
FIG. 1 is a perspective view of an air compressor system constructed in accordance with the teachings of the present disclosure.
Figure 2:
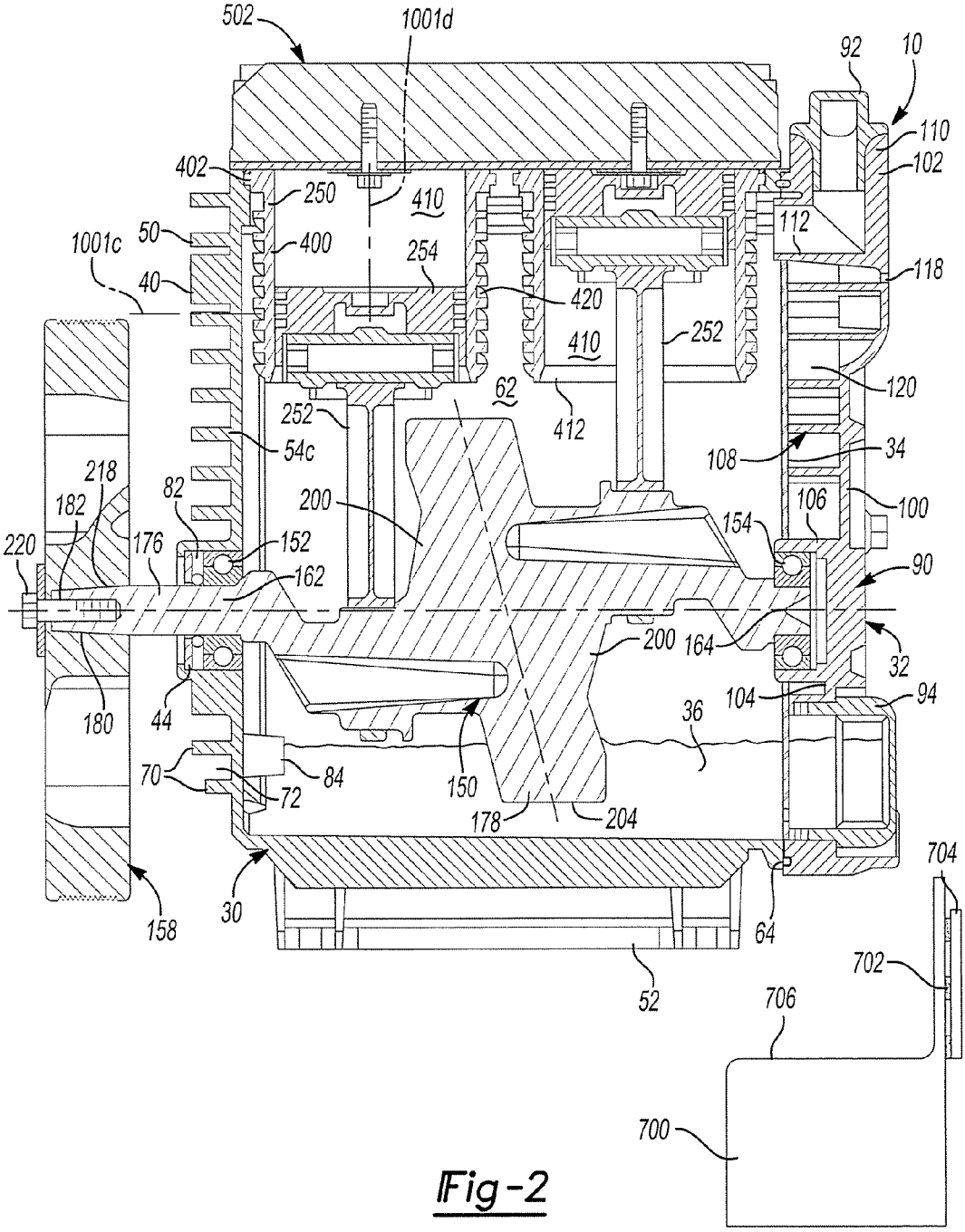
FIG. 2 is a cross-sectional view of the air compressor system of FIG. 1 in which the cross-section is taken longitudinally through the air compressor system in a direction that is perpendicular to both a rotational axis of the crankshaft and the axes in which the piston domes reciprocate.
Figure 3:
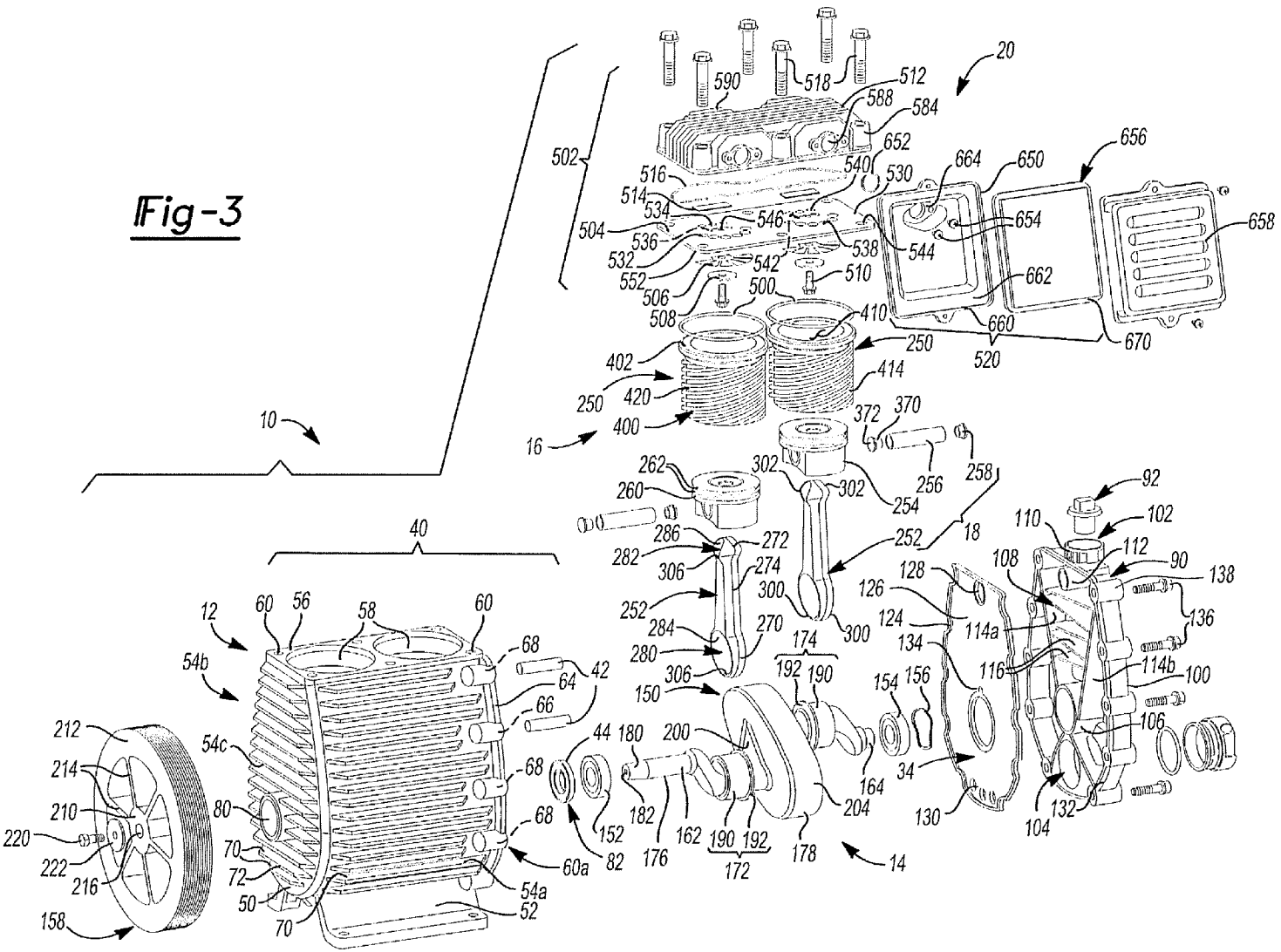
FIG. 3 is an exploded perspective view of the air compressor system of FIG. 1.

With reference to FIGS. 1 through 3 of the drawings, an air compressor system constructed in accordance with the teachings of the present disclosure is generally indicated by reference numeral 10. The air compressor system 10 can include a cylinder block group 12, a crankshaft group 14, a piston kit group 16, which can include a pair of piston kits 18, and a cylinder head group 20.

Cylinder Block Group

With reference to FIGS. 2 and 3, the cylinder block group 12 can include a cylinder block assembly 30, a rear cover assembly 32 and a rear cover gasket 34 that can cooperate to form a sump 36 for containing a liquid lubricant, such as oil. It will be appreciated that the air compressor system 10 is configured to operate such that the liquid lubricant in the sump 36 has an upper surface (i.e., a liquid lubricant fill level).

The cylinder block assembly 30 can include a cylinder block 40, a pair of locating dowels 42 and a shaft seal 44. The cylinder block 40 can include a case or block 50 and mounting base 52 that can be integrally formed with the block 50 and configured in a manner that facilitates the mounting of the block 50 to another structure, such as a frame (not shown). The block 50 can include a plurality of sidewalls 54*a*, 54*b* and 54*c*, and a head deck 56 having one or more counterbores 58 and a plurality of threaded head bolt apertures 60 formed therein. In the particular example provided, the sidewalls 54*a*, 54*b* and 54*c* and head deck 56 are arranged to such that the counterbores 58 are oriented to provide an in-line configuration in which the piston kits 18 are disposed in a single row along vertically extending axes, but those of ordinary skill in the art will appreciate that the block 50 could be otherwise configured to provide any desired orientation of the piston kits 18, such as a V or opposed cylinder configuration. Also in the particular example provided, the block 50 is shaped (as seen in front or rear plan view) in the form that is similar to that of a truncated tear drop (i.e., a tear drop with a flattened upper end).

The block 50 can define a rear opening 60*a*, an internal cavity 62 and a joint flange 64 that extends around the rear opening 60*a* and against which the rear cover gasket 34 can sealing abut. A pair of dowel holes 66 and a plurality of threaded bolt holes 68 can be formed into the block 50 generally perpendicular to the joint flange 64. The locating dowels 42 can be received into the dowel holes 66 and can be employed to locate both the rear cover gasket 34 and the rear cover assembly 32 to the block 50. The sidewalls 54*a*, 54*b* and 54*c* can include a plurality of external cooling ribs 70 that can provide the block 50 with increased external surface area and/or cooperate to form a plurality of flow channels 72. In the particular example provided, the external cooling ribs 70 on the opposite facing sidewalls 54*a* and 54*b* extend longitudinally over substantially the entire surface of the sidewalls

54*a* and 54*b*, while the cooling ribs 70 on the front sidewall 54*c* are oriented generally perpendicular to the cooling ribs 70 on the opposite facing sidewalls 54*a* and 54*b*. Optionally, the block 50 can further include a plurality of internal cooling ribs (not shown) that can be configured to increase the internal surface area of the block 50 and/or to direct the flow of lubricant within the block 50 in a desired manner. The internal cooling ribs can be arranged in any desired manner, such as parallel or transverse (e.g., perpendicular) to the external cooling ribs 70.

The front sidewall 54*c* can define a shaft aperture 80, an annular pocket 82 that is disposed about the shaft aperture 80, and one or more sensor bosses 84. The shaft seal 44 can be received in the annular pocket 82 and sealingly engaged to the block 50. Each sensor boss 84 can be formed to receive a sensor, such as a float sensor (not shown) or a temperature sensor (not shown), which can sense a lubricant level and lubricant temperature, respectively, and generate a lubricant level signal and a lubricant temperature signal, respectively. The lubricant level signal and/or the lubricant temperature signal can be employed by a controller (not shown) to halt or prevent the operation of the air compressor system 10 if the amount of the lubricant within the block 50 is less than a desired amount and/or if the temperature of the lubricant within the block 50 exceeds a desired amount. It will be appreciated that the air compressor system 10 could be an "oil-less" type of compressor and as such, the sensor boss(es) 84 may be present but not machined or may be plugged.

Figure 4:
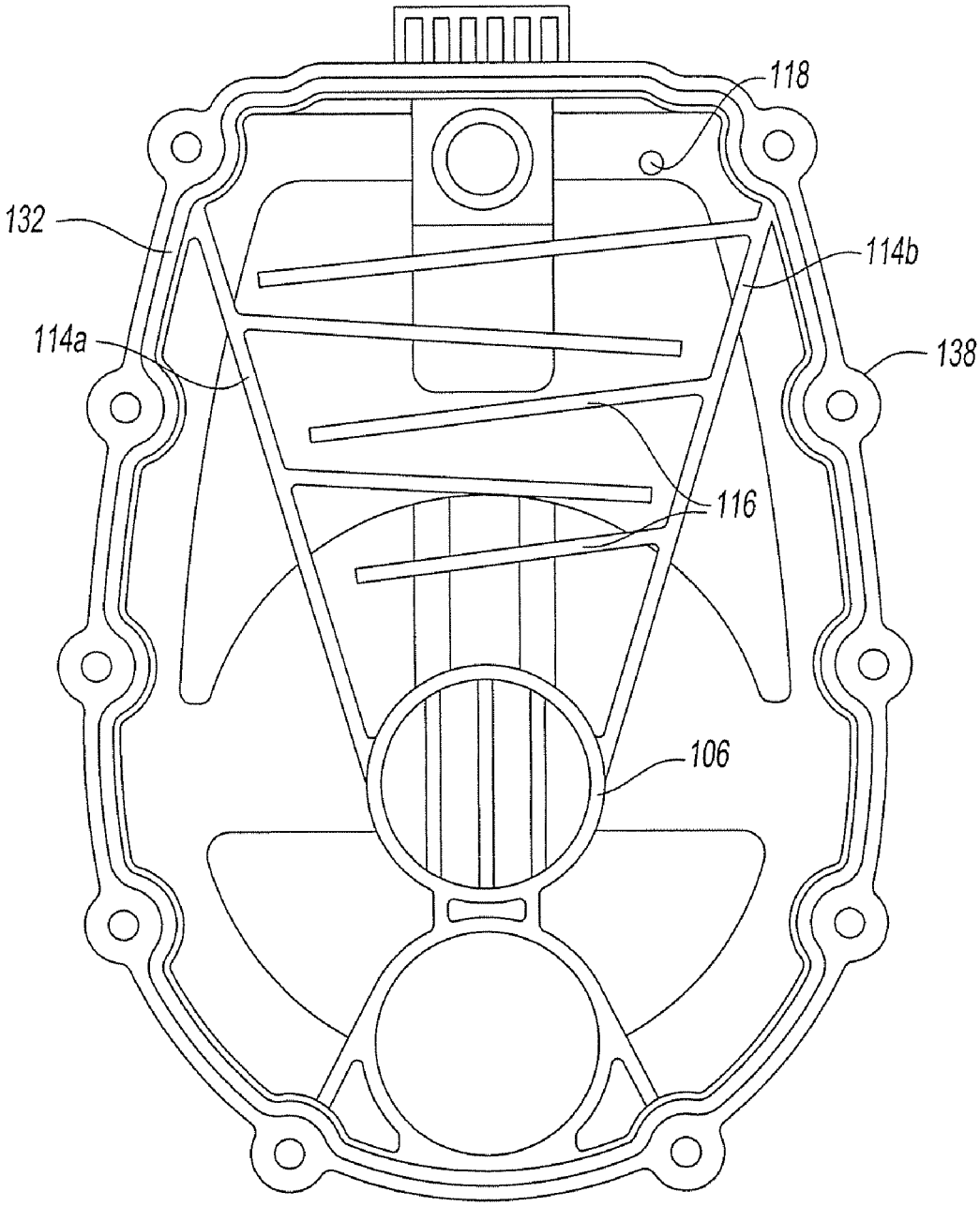
FIG. 4 is an elevation view of a portion of the air compressor system of FIG. 1, illustrating the rear cover in more detail.

The rear cover assembly 32 can include a rear cover 90, a fill plug 92 and a drain plug assembly 94. With additional reference to FIG. 4, the rear cover 90 can be formed of a suitable material, such as die cast aluminum or an injection molded plastic, and can define a cover portion 100, a lubricant inlet port 102, a lubricant outlet port 104, a bearing hub 106 and a breather labyrinth 108. The cover portion 100 can be configured to span and close the rear opening 60*a*. The lubricant inlet port 102 can be a conduit or channel that can extend through the cover portion 100. In the particular example provided, the lubricant inlet port 102 includes a collar portion 110, which is located on a top surface of the cover portion 100, and a tube portion 112. A first end of the tube portion 112 is coupled in fluid communication with the collar portion 110, while a second, opposite end of the tube portion 112 can extend toward or into the internal cavity 62 in the block 50. The lubricant outlet port 104 and the drain plug assembly 94 can be constructed in a manner that is similar to that which is disclosed in U.S. patent application Ser. No. 11/154,020 entitled "Reservoir Seal With Fluid Level Indicator", the disclosure of which is hereby incorporated by reference as if fully set forth in detail herein. The breather labyrinth 108 can include a pair of tapering sidewalls 114*a* and 114*b*, a plurality of baffle plates 116 and a breather outlet 118, which can be a hole formed through the cover portion 100. The tapering sidewalls 114*a* and 114*b* can cooperate with the cover portion 100 and the bearing hub 106 to define a breather space into which the baffle plates 116 and the breather outlet 118 can be disposed. Each of the baffle plates 116 can be coupled to the cover portion 100 and one of the tapering sidewalls 114*a* and 114*b* and spaced apart from the other one of tapering sidewalls 114*a* and 114*b* to define a zigzagging channel 120.

The rear cover gasket 34 can include a perimeter seal portion 124, a labyrinth cover 126, a lubricant inlet aperture 128 and a lubricant baffle 130. In the particular embodiment illustrated, the rear cover gasket 34 is unitarily formed of a very highly bound nitrile, high viscosity NBR copolymer, but those of skill in the art will appreciate that the rear cover gasket 34 may be formed of two or more discrete components. For example, an O-ring or a suitable amount of Permatex® RTV can be employed to form the perimeter seal portion 124. The perimeter seal portion 124 can be raised relative to an adjacent portion of the rear cover gasket 34 and can be sized to be received into a seal groove 132 that can be formed in the cover portion 100 of the rear cover 90. The labyrinth cover 126 can extend over the breather labyrinth 108 and can include an inlet aperture 134 that can be disposed proximate the bearing hub 106 when the rear cover gasket 34 is affixed to the rear cover 90. The tube portion 112 can extend through the lubricant inlet aperture 128. It will be appreciated that pressure within the internal cavity 62 of the block 50 can be vented into the breather labyrinth 108 through the inlet aperture 134 and out the breather outlet 118. It will be further appreciated that lubricant entrained in the air flowing through the breather labyrinth 108 can collect on the baffle plates 116 and drain back to the sump 36. In this regard, cross-holes (not shown) can be formed in the bearing hub 106 to permit the lubricant that drains from the breather labyrinth 108 to drain into the bearing hub 106 and lubricate the crankshaft group 14. The lubricant baffle 130 can permit fluid communication between the internal cavity 62 and the lubricant outlet port 104 and can attenuate a surge of lubricant toward or away from the drain plug assembly 94 so that the level of lubricant in the internal cavity 62 may be more accurately determined via a sight glass (not specifically shown) within the drain plug assembly 94.

Fasteners 136 may be positioned through bosses 138 in the rear cover 90 and threadably engaged to the threaded bolt holes 68 in the block 50 to thereby fixedly but removably couple the rear cover assembly 32 to the cylinder block 40.

Crankshaft Group

The crankshaft group 14 can include a crankshaft 150, first and second bearings 152 and 154, a thrust washer 156, and a front or driven pulley 158. The crankshaft 150 can include first and second main bearing journals 162 and 164, respectively, first and second pin journals 172 and 174, respectively, a shaft member 176, and a counterweight 178. The first and second main bearing journals 162 and 164 are disposed on opposite sides of the crankshaft 150 and are sized to be received in the first and second bearings 152 and 154, respectively. The first and second bearings 152 and 154 can be any type of bearing, such as a ball or roller bearing, and can be sized to be received in the bearing hub 106 and the annular pocket 82, respectively, to support the crankshaft 150 for rotation within the internal cavity 62. The shaft member 176 can extend from the second main bearing journal 162 through the front sidewall 54*c* and can sealingly engage the shaft seal 44. The shaft member 176 can be configured in any manner desired, but in the particular example provided, the shaft member 176 includes a tapered segment 180 and a threaded aperture 182. The first and second pin journals 172 and 174 are disposed on opposite sides of the counterweight 178 and are generally similar in their construction. Accordingly, a discussion of the first pin journal 172 with suffice for the second pin journal 174. The first pin journal 172 can include a journal portion 190 and an annular rim 192 that can abut the journal portion 190 on a side that is closest to the counterweight 178. The journal portion 190 can define an axis that can be offset from the rotational axis of the crankshaft 150. The journal portion 190 can be relatively large in diameter so as to be larger in cross-sectional area than the shaft member 176, the first main bearing journal 162 or the portion of the crankshaft 150 that interconnects the first main bearing journal 192 and the journal portion 190. The counterweight 178 can be shaped in the form of a round plinth that is mounted somewhat transverse to the rotational axis of the crankshaft 150 such that portions of the counterweight 178 can extend in-line with the portions of the first and second pin journals 172 and 174. The counterweight 178 can be tilted relative to an axis that is perpendicular to a rotational axis of the crankshaft 150 by an angle of about 10° to about 30° and in the particular example provided, the angle is about 15°. Gussets 200 can be employed to support the counterweight 178 where the counterweight 178 leans over the first and second pin journals 172 and 174. The perimeter 204 of the counterweight 178 can be configured in a manner that resists, reduces or minimizes the atomization of the lubricant in the internal cavity. In the example provided, the perimeter 204 of the counterweight 178 is an "sand-cast" surface (i.e., not machined) and relatively round so that some portion of the perimeter 204 is always immersed in the lubricant in the internal cavity 62 (i.e., some portion of the perimeter 204 extends below the liquid lubricant fill level) and no parts of the counterweight 178 impact upon the top surface (liquid lubricant fill level) of the lubricant. The thrust washer 156 can be employed to limit axial end play of the crankshaft 150 relative to the block 50. In the example provided, the thrust washer 156 is a spring washer that can be received in the bearing hub 106 to bias the second bearing 154 and the crankshaft 150 toward the front sidewall 54*c* of the block 50.

The driven pulley 158 can include a hub portion 210, a rim portion 212 and a plurality of spokes 214 that can interconnect the hub portion 210 and the rim portion 212. The hub portion 210 can include a through-hole 216 that can include a mating tapered portion 218 that is configured to matingly engage the tapered segment 180 of the shaft member 176. A threaded fastener 220 can be inserted through a Bellville spring washer 222 and the through-hole 216 in the driven pulley 158 and threadably engaged to the threaded aperture 182 in the shaft member 176 to thereby fixedly but removably couple the driven pulley 158 to the crankshaft 150. The spokes 214 can be formed in any desired manner and in the particular example provided, the spokes 214 are formed as straight vanes that draw air through the driven pulley 158 toward the front sidewall 54*c* when the driven pulley 158 is rotated about the rotational axis of the crankshaft 150 in a predetermined rotational direction. It will be appreciated that the spokes 214 could be formed in the alternative as curved vanes. The rim portion 212 can be formed in a desired manner to frictionally engage a drive belt (not shown). In one form, the driven pulley 158 is net formed from a powdered metal material and as such, the outer edge of the rim portion 212 and the through-hole 216 need not be machined.

Piston Kit Group

The piston kit group 16 can include the pair of piston kits 18 and a pair of cylinders 250. Each of the piston kits 18 can include a connecting rod 252, a piston or piston dome 254, a wrist pin 256, a pair of pin plugs 258, an oil control ring 260 and a pair of compression rings 262. The piston domes 254 are illustrated in the particular example provided as reciprocating along a vertical axis (e.g., axis 1001*d*) when the air compressor system 10 is disposed in an operating position (shown in FIGS. 1 and 2).

Each connecting rod 252 can include a crank pin portion 270, a wrist pin portion 272 and a beam 274 that can interconnect the crank pin portion 270 to the wrist pin portion 272. The crank pin portion 270 can define a crank pin aperture 280 that can be sized to receive the journal portion 190 of an associated one of the first and second pin journals 172 and 174. The wrist pin portion 272 can define a wrist pin aperture 282 that can be sized to receive an associated one of the wrist pins 256. The crank pin portion 270 and the wrist pin portion 272 can be integrally formed with the beam 274 and can present continuous or nearly continuous bearing surfaces 284 and 286, respectively. The crank pin portion 270 and the wrist pin portion 272 can be symmetric about a longitudinally extending centerline of the connecting rod 252. The lateral surfaces 300 and 302 of the crank pin portion 270 and the wrist pin portion 272, respectively, can taper inwardly toward the longitudinally extending centerline of the connecting rod 252 with increasing distance from the beam 274. Construction in this manner can minimize the mass of the connecting rod 252 while maintaining the strength of the connecting rod 252 and surface area of the bearing surfaces 284 and 286 at important areas. In the example provided, transverse grooves 306 are formed in the bearing surfaces 284 and 286 of the crank pin portion 270 and the wrist pin portion 272. More specifically, one transverse groove 306 is formed in the crank pin portion 270 on an end opposite the beam 274, and another transverse groove 306 is formed in the wrist pin portion 272 on an end adjacent the beam 274. The transverse grooves 306 are employed to retain oil on the interior (bearing) surface of the crank pin portion 270 and on the interior (bearing) surface of the wrist pin portion 272.

Figure 5:
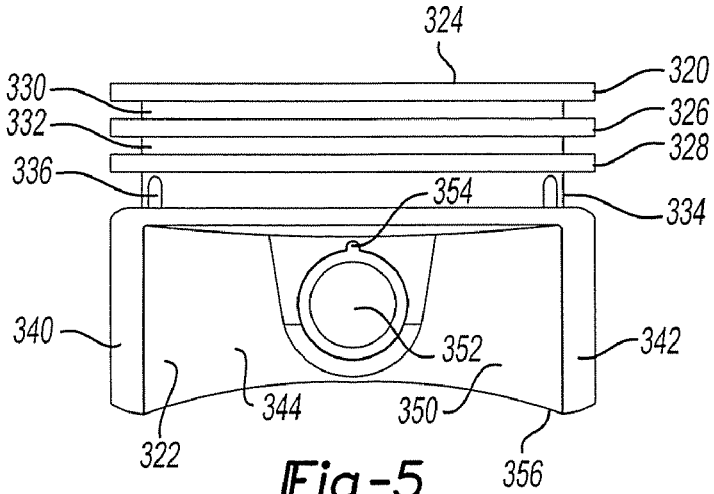
FIGS. 5 and 6 are side elevation views of a portion of the air compressor system of FIG. 1, illustrating the piston dome in more detail.
Figure 6:
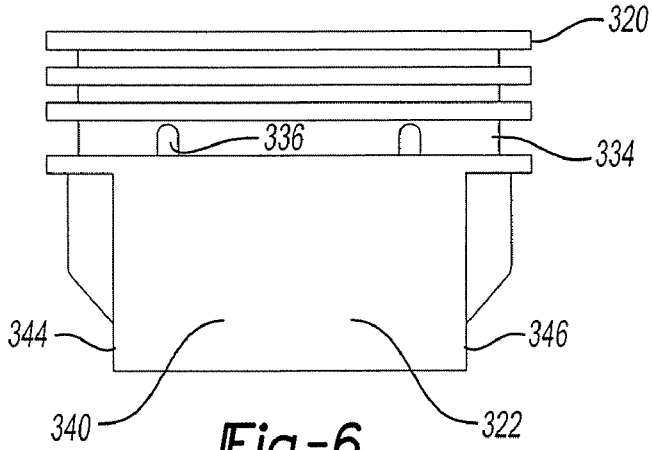
Figure 7:
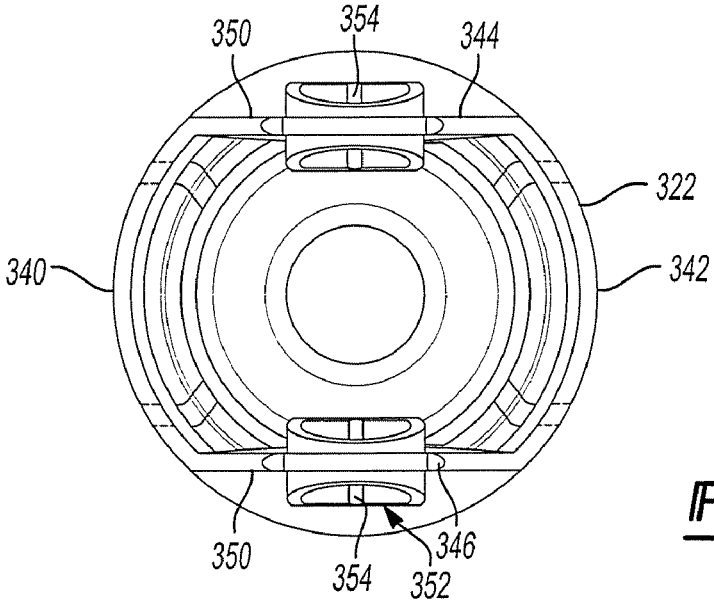
FIG. 7 is a bottom view of the piston dome.

With reference to FIGS. 5 through 7, each piston dome 254 can include a first body portion 320 and a second body portion 322. The first body portion 320 can define an upper surface 324, which can be contoured to clear portions of the cylinder head group 20, and an annular sidewall 326 that can include first, second and third ring grooves 330, 332 and 334, respectively. Radially inwardly extending holes 336 can be formed about the circumference of the first body portion 320. The radially inwardly extending holes 336 can intersect the third ring groove 334. The second body portion 322 can be coupled to the first body portion 320 and can include first and second annular sidewall segments 340 and 342, respectively, and first and second connecting wall segments 344 and 346, respectively. The first and second annular sidewall segments 340 and 342 can be aligned to a plane in which the connecting rod 252 (FIG. 2) pivots and reciprocates. The first and second annular sidewall segments 340 and 342 can be sized in a manner that is consistent with the sizing of the annular sidewall 326. The first and second connecting wall segments 344 and 346 can be disposed orthogonal to the plane in which the connecting rod 252 (FIG. 2) pivots and reciprocates and can interconnect the first and second annular sidewall segments 340 and 342. The first and second connecting wall segments 344 and 346 can be spaced apart from one another such that the dimension between the first and second connecting wall segments 344 and 346 in a direction perpendicular to the plane is less than the dimension between the first and second annular sidewall segments 340 and 342 in a direction that is within the plane. In the particular example provided, the first and second connecting wall segments 344 and 346 include an exterior surface 350 that is generally parallel to the plane when the piston kits 18 (FIG. 2) are installed to the crankshaft 150 (FIG. 2). A wrist pin bore 352 can be formed through the first and second connecting wall segments 344 and 346 in a direction that is generally perpendicular to the plane. Lubricating grooves 354 can be formed in the first and second connecting wall segments 344 and 346. The lubricating grooves 354 can be disposed generally parallel to and intersect the wrist pin bore 352. The lower surface 356 of the first and second connecting wall segments 344 and 346 can be arcuate in shape.

With additional reference to FIGS. 2 and 3, the wrist pin portion 272 of the connecting rod 252 is positioned between the first and second connecting wall segments 344 and 346 the wrist pin aperture 282 is aligned to the wrist pin bore 352. The wrist pin 256, which can be a hollow cylindrical structure, can be received in the wrist pin bore 352 and the wrist pin aperture 282 to thereby couple the piston dome 254 to the connecting rod 252. The pin plugs 258 can be formed of an appropriate deflectable and/or resilient material, such as plastic, and can include a neck portion 370 and a cap portion 372 that can be larger in diameter than the neck portion 370 and the wrist pin 256. The neck portion 370 can be received into and frictionally engage the wrist pin 256. Contact between the cap portion 372 of the pin plugs 258 and the first and second connecting wall segments 344 and 346 can limit movement of the wrist pin 256 relative to the piston dome 254. The compression rings 262 and the oil control ring 260 can be constructed in a manner that is well known in the art and as such, further discussion of these components need not be provided. The compression rings 262 can be installed to the first and second ring grooves 330 and 332 in the piston dome 254, while the oil control ring 260 can be installed to the third ring groove 334.

With reference to FIGS. 2 and 3, each of the cylinders 250 can include a cylinder body 400 and a cylinder flange 402 that can extend about the circumference of the cylinder body 400. The cylinders 250 can be unitarily formed of a desired material, such as cast iron, and can be heat-treated, ground and optionally honed in a desired manner. It will be appreciated that other materials can be used for the cylinders 250, such as aluminum, and that various surface treatments can be used on the surfaces (e.g., inner surface) of the cylinders 250 to provide desired properties (e.g., hardness, wear resistance). The cylinder body 400 is configured to be received through an associated one of the counterbores 58 in the head deck 56, while the cylinder flange 402 is configured to seat against the bottom of the associated one of the counterbores 58. It will be appreciated by those of skill in the art that as the cylinders 250 are recessed into the block 50, the cylinders 250 are not directly air cooled as in conventional consumer and professional grade air compressor systems.

Figure 7A:
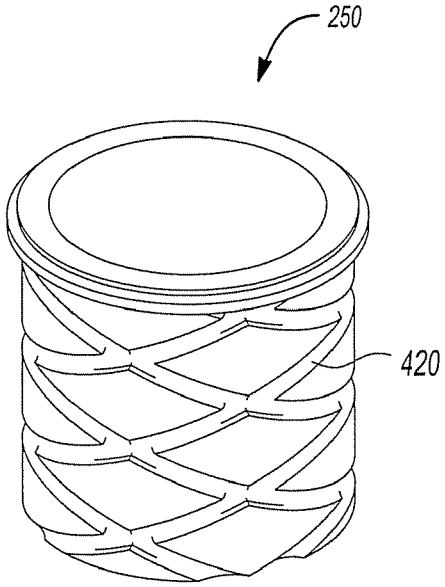
FIGS. 7A through 7D are perspective views of alternately constructed cylinders having cooling channels that are formed in various patterns.
Figure 7B:
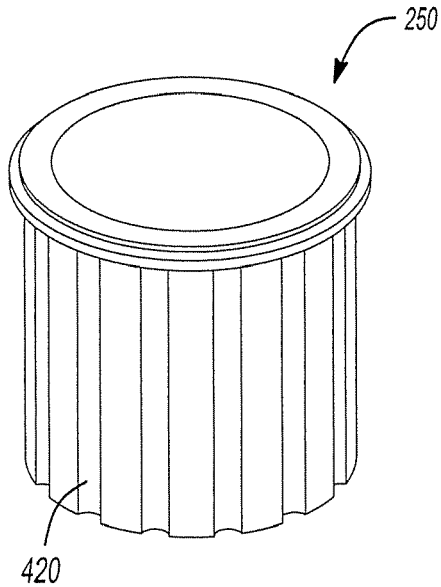
Figure 7C:
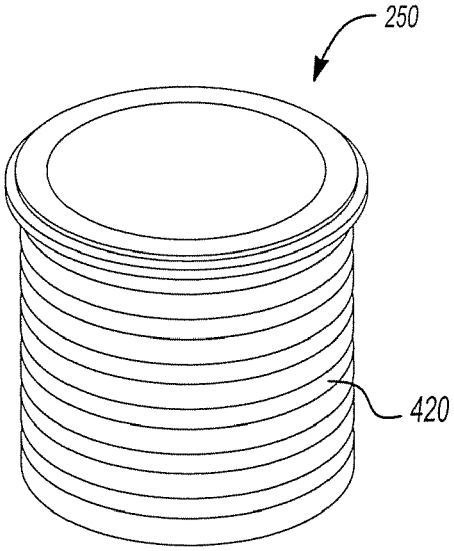
Figure 7D:
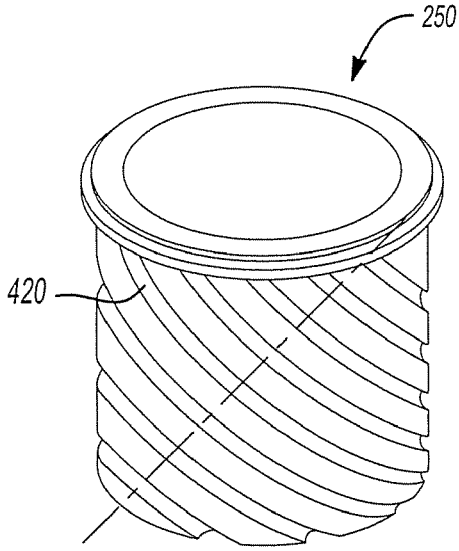
Figure 8:
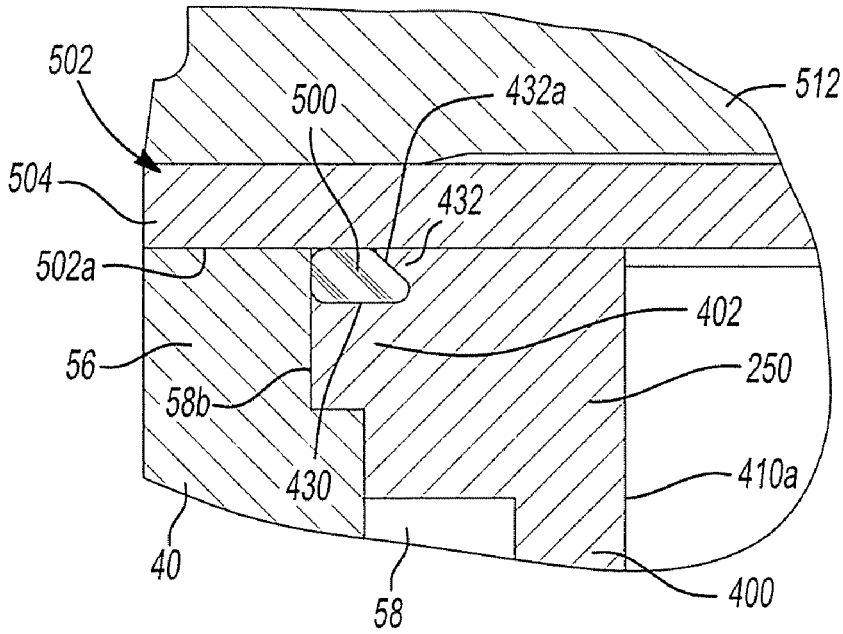
FIG. 8 is an enlarged portion of FIG. 3 illustrating the intersection of the head assembly, the cylinder and the cylinder block in more detail.

The cylinder body 400 can define a piston bore 410, an internal chamfer 412, which can intersect the piston bore 410 on a side opposite the cylinder flange 402, and an exterior surface 414 that can be contoured so as to collect lubricant and control the flow of lubricant from the exterior surface 414 as the lubricant drains back to the bottom of the internal cavity 62. For example, the exterior surface 414 can include one or more flow channels 420 that can be shaped in a desired manner, such as helically spiraling downwardly from the cylinder flange 402. It will be appreciated, however, that the flow channels 420 can be formed in any desired manner and can comprise one or more helixes, one or more grooved crosshatches (FIG. 7A), one or more grooves extending parallel to an axis about which the piston kits 18 reciprocate (FIG. 7B), one or more grooves extending transverse to (e.g., concentrically about) an axis about which the piston kits 18 reciprocate (FIG. 7C), one or more grooves extending helically about an axis that is transverse to an axis about which the piston kits 18 reciprocate (FIG. 7D) and combinations thereof. The flow channel 420 can provide the cylinders 250 with increased surface area (relative to a similar cylinder constructed with a flat exterior surface). Moreover, the flow channel 420 can collect lubricant that is slung upwardly toward the cylinder head group 20 by the counterweight 178 of the crankshaft 150 as the crankshaft 150 rotates and cause the collected oil to flow over the exterior surface 414 in a predetermined manner. The oil that flows over the exterior surface 414 can collect heat from the cylinder body 400 before the oil returns (falls from the cylinder 250) to the sump 36. With additional reference to FIG. 8, the cylinder 250 can include an annular land 430 and an annular lip 432 that is disposed inwardly about the circumference of the annular land 430. The piston bore 410 can be sized to receive an associated one of the piston kits 18 such that the piston dome 254 is slidingly received therein and the compression rings 262 and the oil control ring 260 are engaged to the interior surface 410*a* of the cylinder 250. It will be appreciated that the compression rings 262 and the oil control ring 260 can expand about the piston dome 254 and that they are radially inwardly compressed by the cylinder 250 when the piston kit 18 is received in the piston bore 410. The internal chamfer 412 can be sized to aid in locating the piston dome 254 to the piston bore 410 and to compress the compression rings 262 and the oil control ring 260 as the piston kit 18 is inserted into the cylinder 250.

While the cylinders 250 have been described thus far as including a cylinder body 400 having one or more integrally formed flow channels 420, it will be appreciated that the flow channel(s) 420 may be separately formed and fitted to a remainder of the cylinder body 400. For example, the structure (not shown) that is to form the flow channel(s) 420 may a structure, such as a helical spring, that is fitted to the exterior of the remainder of the cylinder body 400. The structure can be secured to the remainder of the cylinder body 400 in any appropriate manner, such as by friction or interference fit; one or more fasteners, welds, bonds, adhesives; interlocking of the structure directly to the remainder of the cylinder body 400; and/or combinations thereof.

Figure 8A:
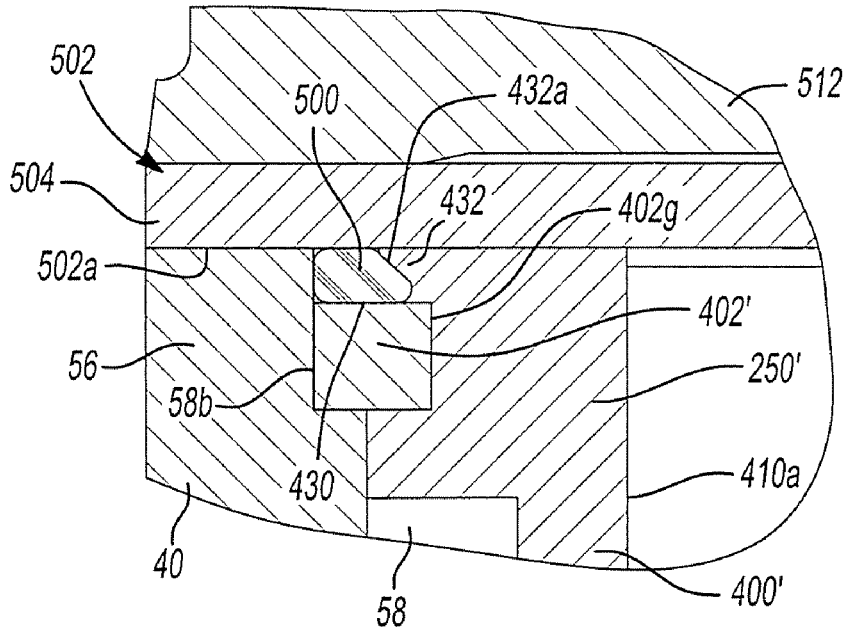
FIG. 8A is a view similar to that of FIG. 8 but illustrating a cylinder having a discrete cylinder flange that is coupled to the cylinder body.

It will also be appreciated that while the cylinders 250 have been described thus far as including a cylinder flange 402 that is integrally formed with the cylinder body 400, the cylinder 250 may be formed as two or more discrete components. In the example of FIG. 8A, the cylinder 250' includes a body 400' and flange 402' that is received into a groove 402*g* that extends about the circumference of the body 400'. The flange 402' can be a snap ring that can be removably received into the groove 402*g*. The cylinder seal 500 can abut the flange 402' and can sealingly engage an exterior surface 432*b* of the annular lip 432, the bottom surface 502*a* of the head assembly 502 and the annular surface 58*b* of the counterbores 58 in the head deck 56. Construction in this manner permits the cylinder bodies 400' and piston kits 18 to be installed to the crankshaft 14 before installation of the crankshaft 14 to the block 50. There cylinder bodies 400' can be pushed through the head deck 56 to expose the groove 402*g*. The cylinder flange 402' can be installed into the groove 402*g* and the cylinder 250' can be urged downwardly into the block 50 to seat the cylinder flange 402' against the bottom surface of the counterbores 58.

Cylinder Head Group

The cylinder head group 20 can include a pair of cylinder seals 500, a head assembly 502, a plurality of head bolts 518 and a filter system 520. The head assembly 502 can include a valve plate 504, a pair of intake valve elements 506, a pair of washers 508 and a pair of threaded fasteners 510, a head 512, a pair of outlet valve elements 514, and a head seal 516.

Each cylinder seal 500 can be an O-ring or other appropriate seal and can sealingly engage an associated one of the cylinders 250, the head assembly 502 and the cylinder block 40. In the particular example provided, the cylinder seal 500 is received about the annular lip 432 (i.e., sealingly engages the outer surface of the annular lip 432) and sealingly abuts the annular land 430, the bottom surface 502*a* of the head assembly 502 and the annular surface 58*b* of the counterbores 58 in the head deck 56. The annular lip 432 can be tapered so as to form an inverted cone (i.e., the surface of the annular lip 432 against which the cylinder seal 500 sealingly engages can be frustro-conical in shape). It will be appreciated from this disclosure that configuration in this manner can prevent the cylinder seal 500 from "rolling off" of the annular lip 432 during assembly of the air compressor system 10 (FIG. 1).

Figure 9:
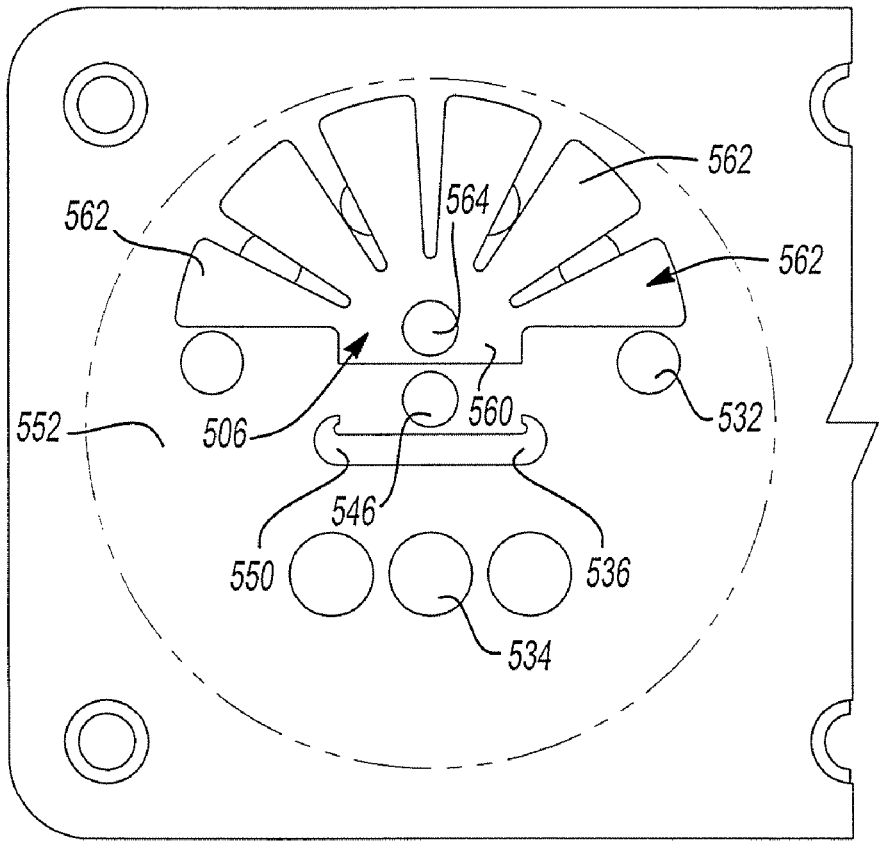
FIG. 9 is an exploded perspective view of a portion of the head assembly illustrating one of the intake valve elements exploded from the valve plate.

The valve plate 504 can include a generally flat body portion 530, a first set of intake apertures 532, a first set of outlet apertures 534, a first set of locating projections 536, a second set of intake apertures 538, a second set of outlet apertures 540 and a second set of locating projections 542. The body portion 530 can define a plurality of head bolt apertures 544 and a pair of fastener apertures 546. The second set of intake apertures 538, the second set of outlet apertures 540 and the second set of locating projections 542 can be identical to the first set of intake apertures 532, the first set of outlet apertures 534 and the first set of locating projections 536, respectively. With additional reference to FIG. 9, the first set of intake apertures 532 and the first set of outlet apertures 534 can be arranged in predetermined patterns about an associated one of the fastener apertures 546. The first set of locating projections 536 can include a channel-shaped projection 550 that can extend from a first side 552 of the body portion 530. The channel-shaped projection 550 can be formed by any appropriate means, such as a weldment, but in the particular example provided, the channel-shaped projection 550 is produced in a fine-blanking operation that simultaneously shapes and sizes the body portion 530, forms the head bolt apertures 544, the fastener apertures 546, the first set of intake apertures 532, the first set of outlet apertures 534, the second set of intake apertures 538, the second set of outlet apertures 540 and the second set of locating projections 542. Unlike the formation of the various apertures through the valve plate 504, it will be appreciated that the channel-shaped projection 550 is only partially sheared from the body portion 530 of the valve plate 504. One or both sides of the first set of intake apertures 532, the first set of outlet apertures 534, the second set of intake apertures 538, and the second set of outlet apertures 540 may be de-burred as necessary prior to assembly of the air compressor system 10.

Each intake valve element 506 can be formed of an appropriate material, such as a spring steel, and can include a valve element body 560 and a plurality of discrete element members 562 that can be coupled to the valve element body 560. A hole 564 can be formed through the valve element body 560 that is sized to receive an associated one of the threaded fasteners 510.

Figure 10:
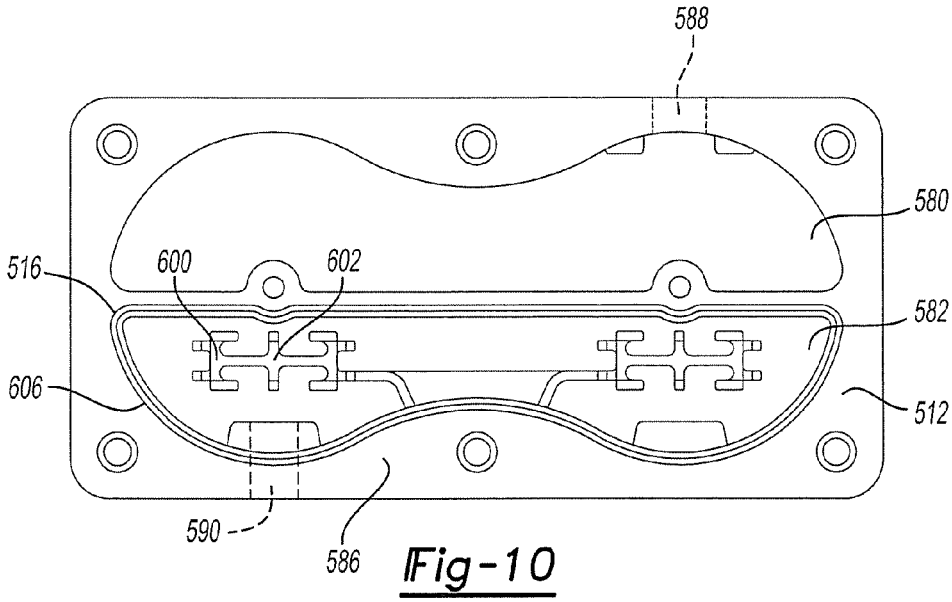
FIG. 10 is a bottom view of a portion of the head assembly illustrating the head seal as installed to the head.

With reference to FIGS. 3 and 10, the head 512 can define a low pressure cavity 580, a high pressure cavity 582, a plurality of head bolt bosses 584, a sealing flange 586, an intake port 588, which can be coupled in fluid communication to the filter system 520, and an outlet port 590, which can be coupled in fluid communication to a reservoir (not shown). The low pressure cavity 580 can be segregated from the high pressure cavity 582 and coupled in fluid communication to the intake port 588, while the high pressure cavity 582 can be coupled in fluid communication to the outlet port 590. A pair of valve pockets 600 can be integrally formed with the head 512 and can be positioned in the high pressure cavity 582. Each valve pocket 600 can include a plurality of legs 602 that can be employed to retain an associated one of the outlet valve elements 514 in a desired orientation in-line with an associated one of the first and second sets of outlet apertures 534 and 540. The head bolt bosses 584 can be configured to receive the head bolts 518 and can be positioned about the head 512 in locations corresponding to the head bolt apertures 544 in the valve plate 504. The sealing flange 586 can be disposed about the head 512 inwardly of the head bolt bosses 584 and can extend between the low pressure cavity 580 and the high pressure cavity 582. In the particular example provided, a seal groove 606 is formed in the sealing flange 586 into which the head seal 516 can be received.

Figure 11:
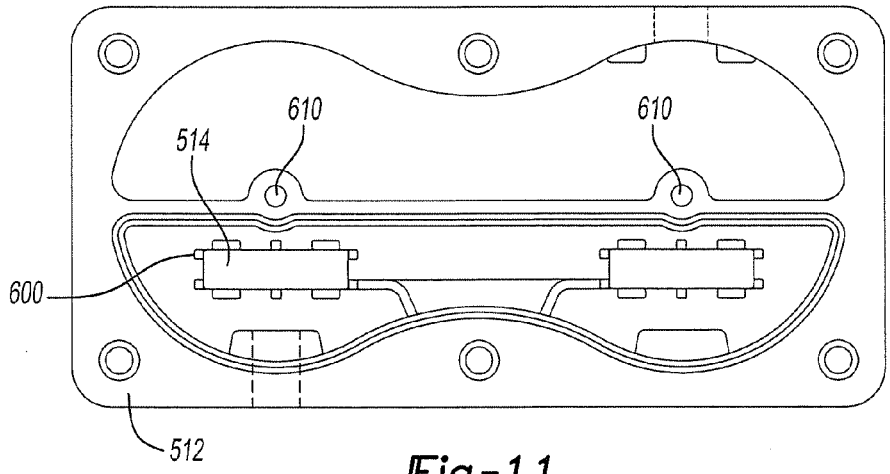
FIG. 11 is a view similar to that of FIG. 10 but illustrating the outlet valve elements as installed to the head.
Figure 12:
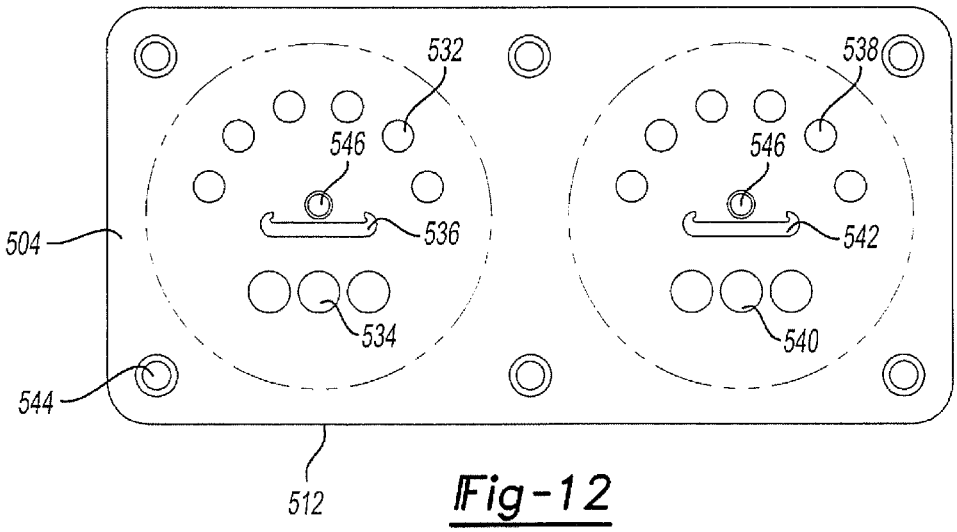
FIG. 12 is a view similar to that of FIG. 11 but illustrating the valve plate as overlaid onto the head.
Figure 13:
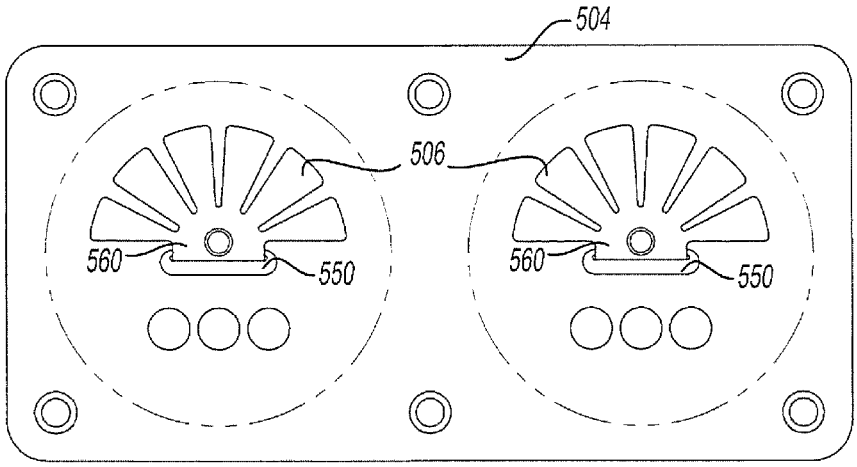
FIG. 13 is a view similar to that of FIG. 12 but illustrating the intake valve elements as overlaid onto the valve plate.

The head assembly 502 can be assembled as follows:

a) place the head 512 such that the sealing flange 586 is facing the assembly technician as shown in FIG. 10;
b) install the head seal 516 to the seal groove 606 as shown in FIG. 10;
c) install the outlet valve elements 514 to the valve pockets 600 as shown in FIG. 11;
d) overlay the valve plate 504 onto the head 512 such that the outlet valve elements 514 (FIG. 11) are aligned to the first and second sets of outlet apertures 534 and 540, the head bolt bosses 584 (FIG. 3) are aligned to the head bolt apertures 544, and the fastener apertures 546 are aligned to corresponding threaded apertures 610 (FIG. 11) in the head 512 as shown in FIG. 12;
e) install the intake valve elements 506 to the valve plate 504 such that the valve element bodies 560 are retained in the channel-shaped projections 550 and the holes 564 are aligned to the fastener apertures 546 (FIG. 12);
f) assembling the fasteners 510 (FIG. 3) to the washers 508 (FIG. 3), inserting the fasteners 510 through a corresponding one of the holes 564 (FIG. 13) and a corresponding one of the fastener apertures 546 (FIG. 12), and threadably engaging the fasteners 510 (FIG. 3) to the threaded apertures 610 (FIG. 11) in the head 512 to produce a clamping force that retains the intake valve elements 506 and the valve plate 504 to the head 512.

It will be appreciated by those of skill in the art from this disclosure that the above-recited assembly steps are exemplary in nature and that these steps need not be performed in the exact order recited herein. In addition to or in lieu of the channel-shaped projection 550, the intake valve elements 506 could be spot welded to the valve plate 504.

The head assembly 502 can be overlaid onto the block 50 and the cylinders 250, the head bolts 518 can be received into the head bolt bosses 584 and threadably engaged to the threaded head bolt apertures 60 to sealingly engage the cylinder seals 500 to the valve plate 504.

Returning to FIG. 3, the filter system 520 can include a filter box 650, a filter gasket 652, a plurality of fasteners 654, a filter element 656, and a filter cover 658. The filter box 650 can be a container-like structure having an open front face 660, a flange 662 and an outlet 664 that can be coupled to the inlet port 588 (FIG. 10) in the head 512. The filter gasket 652 can be disposed between the filter box 650 and the inlet port 588 (FIG. 10) to seal the interface therebetween. The fasteners 654 can permit the filter box 650 to be fixedly but removably coupled to the head 512. The filter element 656 can be received in the filter box 650 and can have a seal element 670 that can be sealingly engaged to the flange 662 and the filter cover 658. The filter cover 658 can be secured to the filter box 650 in any convenient manner, such as via fasteners or resilient snap connectors that can be integrally formed with one or both of the filter cover 658 and the filter box 650. The filter cover 658 can define a plurality of openings through which fresh air may be drawn when the air compressor system 10 is operating.

Operation

With reference to FIGS. 2 and 3, the sump 36 of the air compressor system 10 can be filled to an appropriate level with a liquid lubricant and rotary power can be provided to the crankshaft 150 (via the driven pulley 158) to rotate the crankshaft 150 and reciprocate the piston domes 254 in the piston bores 410. Liquid lubricant clings to the rotating counterweight 178 as portions of the perimeter 204 exit the liquid lubricant in the sump 36. The clinging liquid lubricant can be slung from the counterweight 178 due to centrifugal force prior to re-entry of those portions of the perimeter 204 of the counterweight 178 to the liquid lubricant in the sump 36. As noted above, the counterweight 178 is constructed in a manner that reduces, minimizes or eliminates impacts of the counterweight 178 against an upper surface of the liquid lubricant in the sump 36 to thereby reduce, minimize or eliminate the atomization of liquid lubricant. Accordingly, the counterweight 178 is employed to distribute liquid lubricant upwardly to the exterior surfaces 414 of the cylinders 250, the piston kits 18 and the interior surface 410*a* (FIG. 8) of the piston bores 410. As noted above, the liquid lubricant on the exterior surfaces 414 of the cylinders 250 can follow the flow channels 420 about the circumference and length of the cylinders 250 to thereby draw heat from the cylinders 250 before draining back to the sump 36. Heat in the liquid lubricant in the sump 36 can be transmitted to the block 50. The cooling ribs 70 on the exterior of the block 50 can facilitate conductive and radiant heat exchange to thereby reject heat from the air compressor system 10. Additionally, a source of moving or compressing air, such as the vane-like spokes 214 of the driven pulley 158, can be employed to direct a flow of air against the block 50 to facilitate the rejection of heat from the air compressor system 10 by convection. Significantly, the air compressor system 10 can be tilted relative to a horizontal axis by an angle of up to 20° without starving the piston kit group 16 of lubricating oil.

Those of skill in the art will appreciate from this disclosure that the angled disk-shaped counterweight 178 adds a rotating moment along the rotational axis of the crankshaft 150 to counterbalance the rotating moment produced by the rotation of the first and second pin journals 172 and 174 and reciprocation of the piston kits 18. The required value of the counterbalancing moment may be achieved by selecting a combination of the thickness of the counterweight 178 and the angle at which the counterweight 178 is disposed relative to the rotational axis of the crankshaft 150. A relatively thinner counterweight 178 may be disposed at a relatively higher angle relative to the rotational axis of the crankshaft 150 to achieve the same moment as that which is achieved by the counterweight 178 that is illustrated in the corresponding figures. It may be desirable in some situations to select a relatively thinner counterweight 178 (and a correspondingly larger angle of tilt for the counterweight 178 relative to the rotational axis of the crankshaft 150) to as to reduce the overall weight (and cost) of the crankshaft 150 while increasing the area over which oil may be slung by the counterweight 178.

Figure 13A:
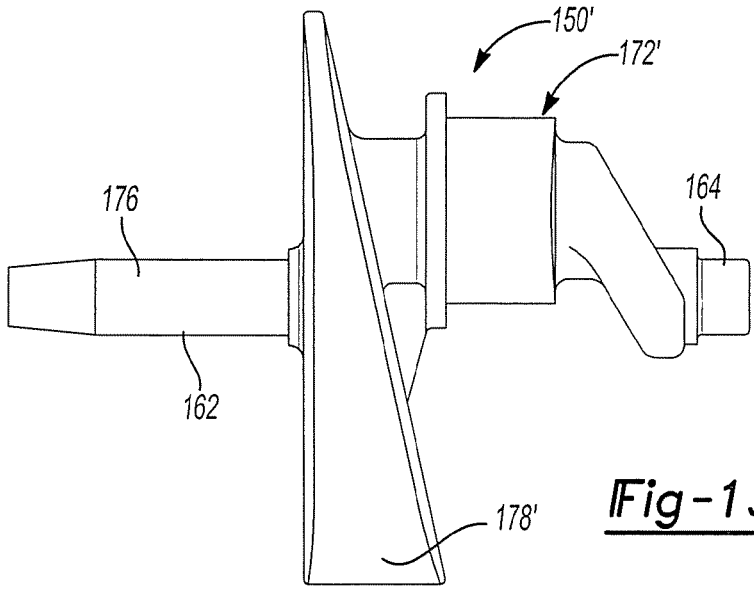
FIG. 13A is a perspective view of a crankshaft for a single-cylinder air compressor system constructed in accordance with the teachings of the present disclosure.

It will be appreciated that the teachings of the present disclosure have application to crankshafts having different numbers of pin journals than that which has been described above. As an example, a crankshaft 150' for a single-cylinder air compressor (not shown) is illustrated in FIG. 13A. In the embodiment illustrated, the crankshaft 150' includes first and second main bearing journals 162 and 164, respectively, a pin journal 172', a shaft member 176 and a counterweight 178'.

Returning to FIGS. 2 and 3, when a piston dome 254 in a cylinder 250 translates downwardly toward the crankshaft 150, a pressure differential is created in the piston bore 410, which causes the element members 562 (FIG. 9) of the intake valve elements 506 to deflect away from the valve plate 504 so that fresh air may be drawn through an associated one of the first and second sets of intake apertures 532 and 538. When the element members 562 (FIG. 9) re-seat against valve plate 504 and the piston dome 254 translates upwardly toward the valve plate 504, the air within the piston bore 410 is compressed. When the air in the piston bore 410 is compressed to a predetermined pressure, the compressed air can deflect the associated outlet valve element 514 away from the valve plate 504 so that pressurized air may be communicated through an associated one of the first and second sets of outlet apertures 534 and 540 to the high pressure cavity 582. In the example provided, the air compressor system 10 is configured to provide relatively high pressure compressed air (e.g., 200 p.s.i.g.) with a single-stage pump.

Maintenance

As will be appreciated by those of skill in the art, the liquid lubricant in the sump 36 will need to be changed on a periodic basis. To facilitate such maintenance, a used oil container 700 can be provided. The used oil container 700 can be formed of an appropriate plastic film and can include one or more bands of adhesive material 702 and a release strip 704. The used oil container 700 can be opened (e.g., unfolded) and an open end 706 of the used oil container 700 can be positioned under the rear cover 90 proximate the drain plug assembly 94 with a first hand of the technician. The other, second hand of the technician can be employed to press one side of the used oil container 700 against the drain plug assembly 94 so that the technician can remove the drain plug assembly 94 from the rear cover 90 with the second hand. It will be appreciated that the second hand is not directly touching the drain plug assembly 94 but rather that a layer of the plastic film that forms one side of the used oil container 700 is disposed between the drain plug assembly 94 and the second hand of the technician. The plastic film thus forms a barrier that is interposed between the technician and the block 50 so that the technician will not be exposed to the used lubricating fluid that exits the block 50 when the drain plug assembly 94 is removed from the rear cover 90. The barrier may be maintained while the drain plug assembly 94 is re-installed to the rear cover 90. Thereafter, the release strip 704 can be removed from the adhesive material 702 and the used oil container 700 can be folded onto itself to seal the open end 706.

In some embodiments, the used oil container 700 can include a reinforcing member (not shown) that can be secured to the rear cover on a temporary basis so that the technician need not hold the used oil container 700 throughout the interval at which the liquid lubricant is being drained from the air compressor system 10. For example, a hole (not shown) can be formed in the reinforcing member and a fastener (not shown) can be received through the hole and threadably engaged to a corresponding threaded hole (not shown) in the rear cover 90 to thereby secure the used oil container 700 to the rear cover 90.

Figure 2A:
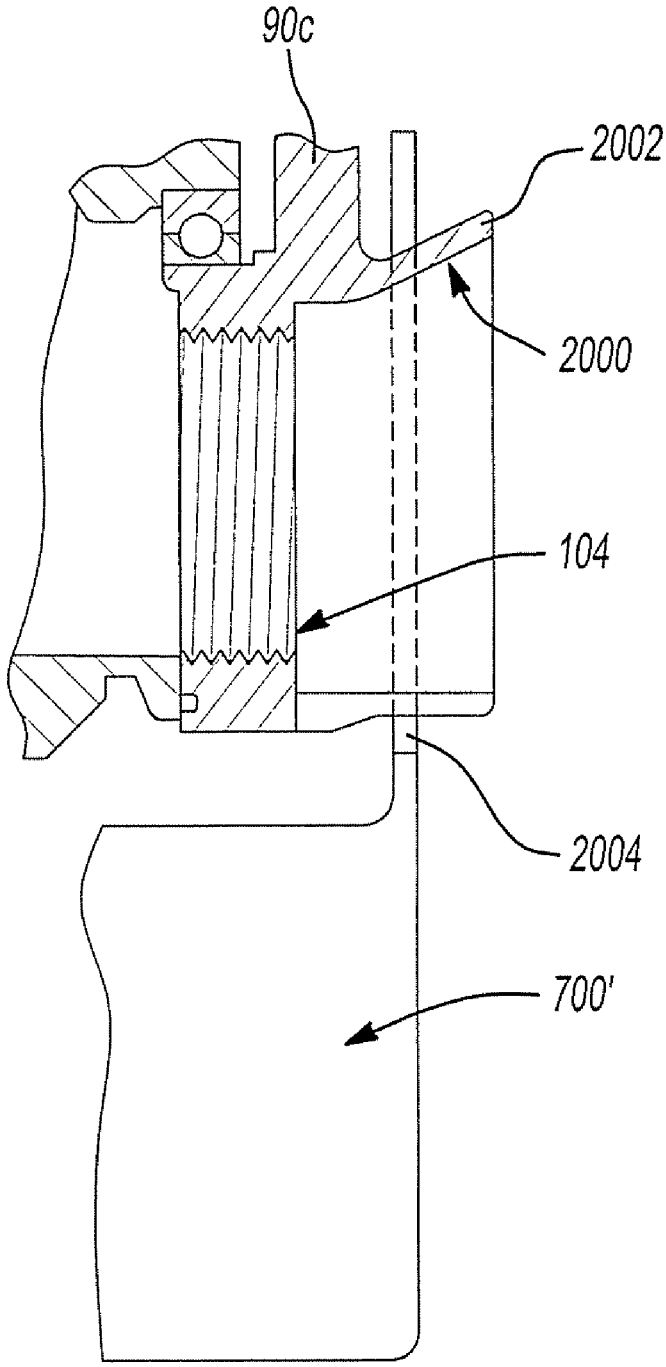
FIG. 2A is a cross-sectional view of an air compressor system illustrating a rear cover with a hook for suspending a used oil container.

In the example of FIG. 2A, the rear cover 90*c* includes a hook 2000, such as a frusto-conical projection 2002 that is disposed about the lubricant outlet port 104. The used oil container 700' can include a circular aperture 2004 that can be fitted about the frusto-conical projection 2002 to permit the used oil container 700' to hang from the hook 2000 while the liquid lubricant is being drained from the air compressor system.

Assembly Method

The air compressor system can be assembled as follows:

a) the shaft seal 44 can be installed to the annular pocket 82 in the block 50;

b) the locating dowels 42 can be installed to the dowel holes 66;

c) the piston kits 18 can be assembled;

d) the first and second bearings 152 and 154 can be installed to the first and second main bearing journals 162 and 164, respectively;

e) a first one of the piston kits 18 can be installed to the crankshaft 150 such that the shaft member 176 is received into the crank pin aperture 280 and the piston kit 18 is moved along the crankshaft 150 to orient the crank pin portion 270 of the connecting rod 252 to the journal portion 190 of the first pin journal 172;

f) the crankshaft 150 can be inserted into the internal cavity 62 of the block 50 such that the shaft member 176 extends through and sealingly engages the shaft seal 44;

g) a second one of the piston kits 18 can be installed to the crankshaft 150 such that the second main bearing journal 164 is received into the crank pin aperture 280 and the piston kit 18 is moved along the crankshaft 150 to orient the crank pin portion 270 of the connecting rod 252 to the journal portion 190 of the second pin journal 174;

h) each cylinder 250 can be aligned to an associated one of the counterbores 58 in the block 50 and inserted thereto while simultaneously receiving an associated one of the piston domes 254 therein;

i) the rear cover gasket 34 can be assembled to the rear cover assembly 32;

j) the rear cover gasket 34 and the rear cover assembly 32 can be installed over the locating dowels 42 and fastened to the block;

k) the cylinder seals 500 can be installed to the annular lips 432 (FIG. 8) of the cylinders 250;

l) the head assembly 502 can be installed over the head deck 56 such that the head bolt bosses 584 are aligned to the threaded head bolt apertures 60 and thereafter tightened to secure the head assembly 502 to the block 50;

m) the driven pulley 158 can be installed over the shaft member 176 and secured to the crankshaft 150 with the threaded fastener 220 and the Bellville spring washer 222.

It will be appreciated by those of skill in the art from this disclosure that the above-recited assembly steps are exemplary in nature and that these steps need not be performed in the exact order recited herein. For example, the first and second bearings 152 and 154 may be installed to the crankshaft 150 after the piston kits 18 are first installed to the first and second pin journals 172 and 174. Moreover, it will be appreciated that the block 50 may be in one orientation during a first portion of the assembly process and thereafter positioned in a different orientation for a remainder of the assembly process. For example, the block could be positioned such that the rotational axis of the crankshaft 150 is in a vertical orientation for steps (a) through (h) and thereafter be positioned such that the crankshaft 150 is in a horizontal orientation.

Figure 15:
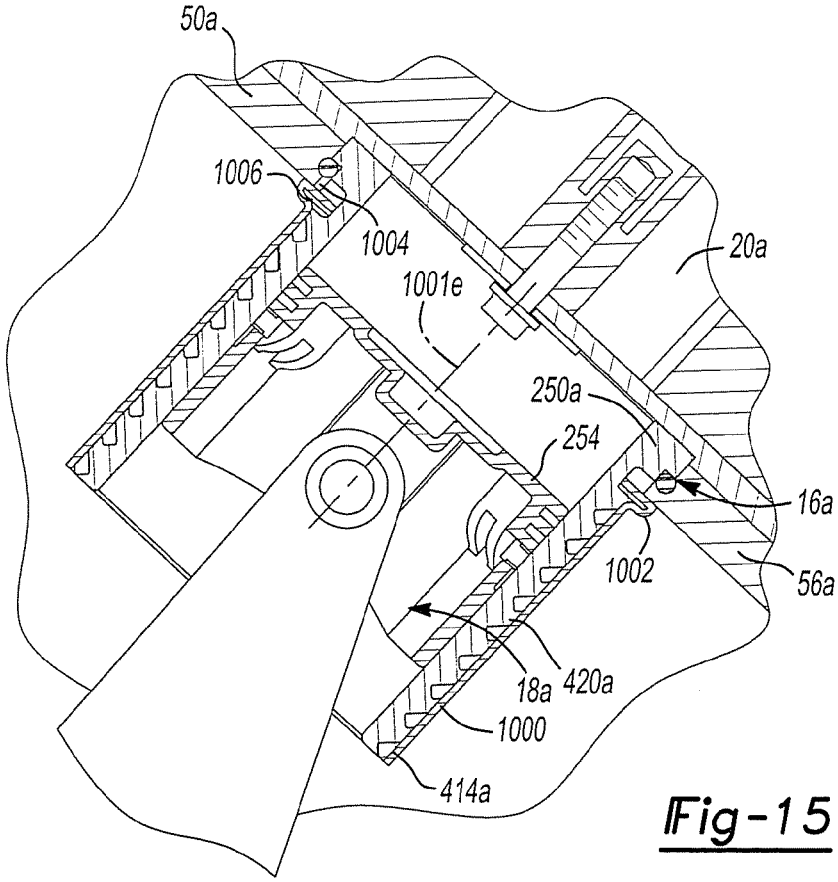
FIG. 15 is a sectional view of a portion of the air compressor system of FIG. 14 taken through one of the piston kits.
Figure 14:
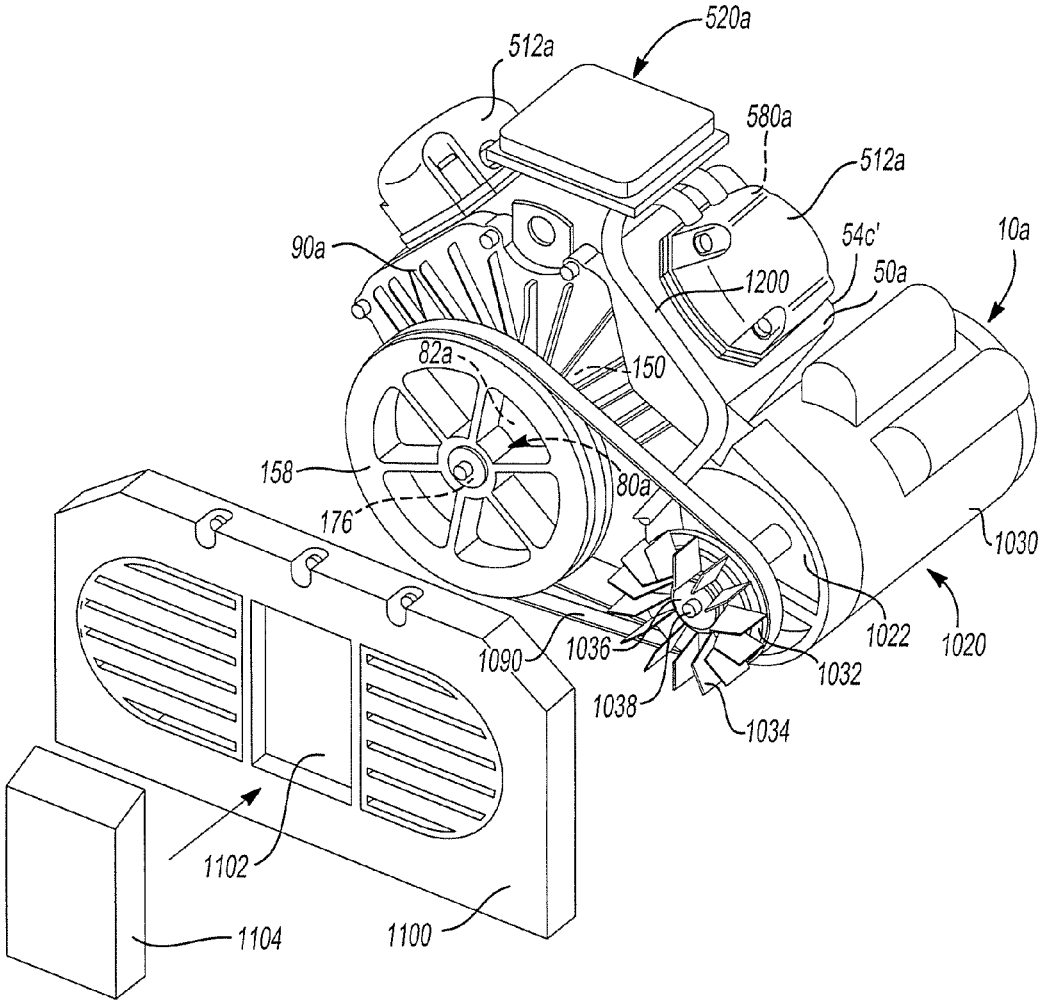
FIG. 14 is a perspective view of another air compressor system constructed in accordance with the teachings of the present disclosure.
Figure 16:
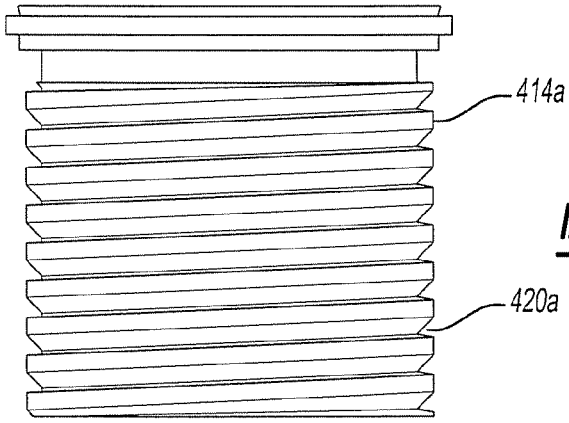
FIG. 16 is a side elevation view of a portion of the air compressor system of FIG. 14, illustrating the cylinder in more detail.
Figure 17:
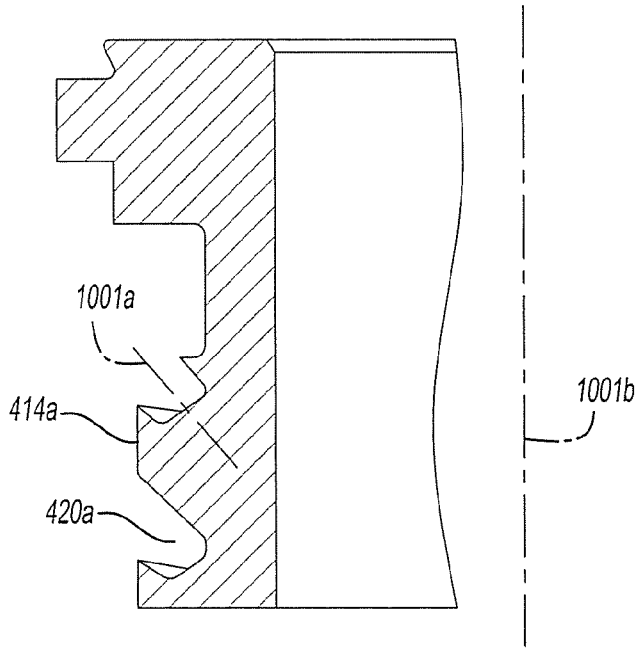
FIG. 17 is a sectional view of a portion of the cylinder.
Figure 18:
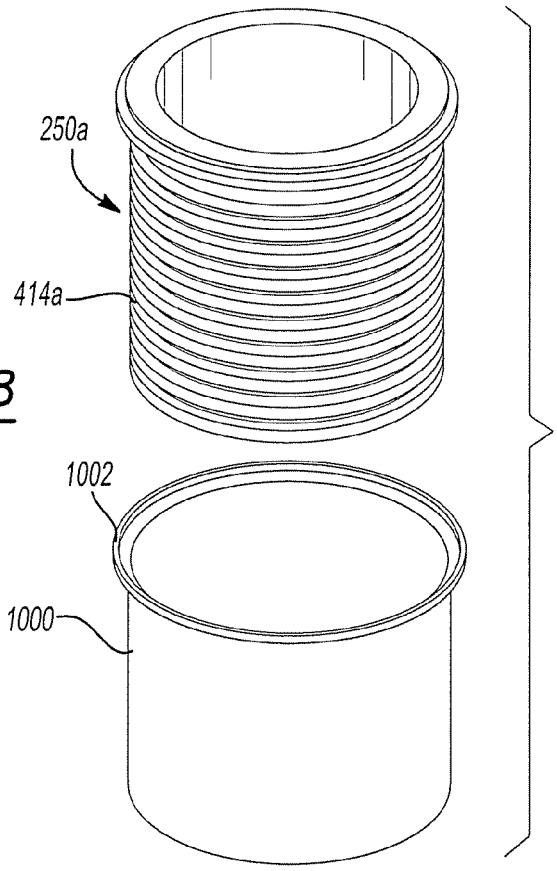
FIG. 18 is an exploded perspective view illustrating the cylinder as exploded from the cylinder sleeve cover.

While the air compressor system 10 has been illustrated and described with regard to a particular in-line two-cylinder configuration, those of skill in the art will appreciate that an air compressor system constructed in accordance with the teachings of the present disclosure may be constructed somewhat differently and could have any desired quantity of cylinders. For example, the air compressor system could be constructed with two cylinders that could be oriented in any desired orientation, such as tilted relative to a vertical axis (when the air compressor system 10*a* is in an operating orientation) by an angle of about 45° as shown in FIGS. 14 and 15 so that the axes 100*l*e along which the piston kits 18*a* reciprocate are spaced apart by an angle of 90°. The piston kit group 16*a* can also includes a cylinder sleeve cover 1000 that can be fitted about the exterior surface 414*a* of the cylinder 250*a*. With additional reference to FIGS. 16 through 18, the flow channels 420*a* can be formed into the exterior surface 414*a* at a desired tooling angle 1001*a* relative to an axis 1001*b* along with the piston dome 254 reciprocates. In contrast, the flow channel 420 that are illustrated in FIG. 2 are formed at a tooling angle 1001*c* that is perpendicular to the axis along which the piston dome 254 translates. In the particular example provided, the flow channels 420*a* are formed at the angle at which the cylinder is tilted relative to a vertical axis (e.g., 45° in the example provided), but it will be appreciated that other angles could be employed. For example, the flow channels could be oriented along a vertical axis even though the cylinder is tilted relative to the vertical axis. The cylinder sleeve cover 1000 can be formed off an appropriate plastic or sheet steel and can include an annular lip 1002 that can be abutted against the head deck 56*a* to permit oil to flow from an oil gallery 1004 in the block 50*a*. In the particular example provided, pressurized oil from an oil pump (not shown) is fed through the block 50*a* and is discharged from the oil gallery 1004 into a cavity 1006 that is defined between the annular lip 432 and the head deck 56*a*. The cylinder sleeve cover 1000 can retain the liquid lubricant in the flow channels 420*a* as it drains down the exterior surface 414*a* of the cylinder 250*a*.

In those air compressor systems that do not employ an oil pump, the annular lip may be spaced apart from the head deck 56*a* and the cylinder flange 402*a* and configured to catch liquid lubricant that is splashed downwardly from the cylinder head group 20*a*. Optionally, a side of the cylinder sleeve cover 1000 that is disposed above the cylinder 250*a* in a vertical direction can be perforated to permit relative more splashed lubricant to collect in the flow channels 420*a*.

Those of skill in the art will appreciate that the flow channels can be formed into the exterior surface at a desired angle relative to an axis along with the piston dome reciprocates, even when the piston dome reciprocates along a vertical axis. Configuration in this manner can provide the flow channel with a cup-like cross-section that can retain relatively more lubricant.

Returning to FIG. 14, the air compressor system 10*a* of the present example can be constructed such that the shaft member 176 of the crankshaft 150 extends through the rear cover 90*a*. Those of skill in the art will appreciate that the bearing hub 106 (FIG. 2) can be formed in the front sidewall 54*c*' of the block 50*a*, while the shaft aperture 80*a* and the annular pocket 82*a* can be formed in the rear cover 90*a* to thereby facilitate the reverse mounting of the crankshaft 150. The rear cover 90*a* can be extended somewhat and can serve as a mounting plate for an electric motor assembly 1020. In this regard, the rear cover 90*a* can include a motor mount portion 1022 having an output shaft aperture (not specifically shown) and a plurality of motor mounting apertures (not specifically shown). The rear cover 90*a* can serve as a mount for coupling the electric motor assembly 1020 and the block 50*a* to an air tank (not shown), either directly or via a frame (not shown) that can be coupled to the air tank.

Figure 19:
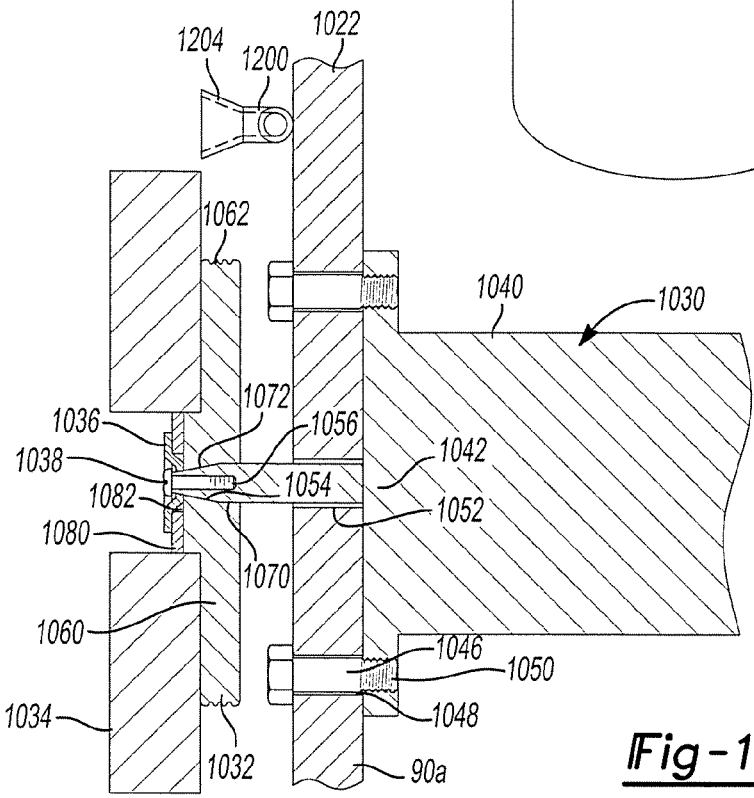
FIG. 19 is a sectional view of a portion of the air compressor system of FIG. 14, illustrating the mounting of the motor assembly to the rear cover in more detail.

The electric motor assembly 1020 can include an electric motor 1030, a motor pulley 1032, a fan 1034, a Belleville washer 1036 and a threaded fastener 1038. It will be appreciated that the fan 1034 can be employed to generate a flow of cooling air that can be employed to cool the air compressor in a manner that is similar to that which is disclosed in U.S. Pat. No. 7,131,824 entitled "Wheeled Portable Air Compressor", the disclosure of which is hereby incorporated by reference as if fully set forth in detail herein. With additional reference to FIG. 19, the electric motor 1030 can be conventionally configured and can include a motor case 1040 and an output shaft 1042. The motor case 1040 can be secured to the motor mount portion 1022 on a side of the rear cover 90*a* to which the block 50*a* is coupled. A plurality of threaded fasteners 1046 can be inserted through the motor mounting apertures 1048 and threadably engaged to corresponding apertures 1050 formed in the motor case 1040 to thereby fixedly but removably couple the electric motor 1030 to the rear cover 90*a*. The output shaft 1042 can extend through output shaft aperture 1052 and can include a tapered end 1054 into which a threaded aperture 1056 can be formed.

The motor pulley 1032 can be formed of a sintered powdered metal material and can include a hub portion 1060 and a rim portion 1062 that can be interconnected to the hub portion 1060 in any desired manner. Like the driven pulley 158, the motor pulley 1032 can be constructed without machining of the outer surface of the rim portion 1062. The hub portion 1060 can include a through-hole 1070 that can include a mating tapered portion 1072 that is configured to matingly engage the tapered end 1054 of the output shaft 1042. The fan 1034 can be formed of a plastic material and can have a hub 1080 with a mounting hole 1082. The hub 1080 can be fitted (e.g., snapped) over the hub portion 1060 of the motor pulley 1032 in a manner that can locate a rotational axis of the fan 1034 to the rotational axis of the motor pulley 1032. Those of skill in the art will appreciate that the tapered end 1054 and the mating tapered portion 1072 can cooperate to align the rotational axis of the motor pulley 1032 to the rotational axis of the output shaft 1042. The mounting hole 1082 of the fan 1034 can be relatively larger in diameter than the through-hole 1070 of the motor pulley 1032. The threaded fastener 1038 can be inserted to the Belleville washer 1036 and threadably engaged to the threaded aperture 1056 in the output shaft 1042; the Belleville washer 1036 can be oriented so as to initially make contact with the head of the threaded fastener 1038 and with the hub 1080 of the fan 1034 (but not the motor pulley 1032). The threaded fastener 1038 can be tightened to deflect the center of the Belleville washer to a point in which it directly contacts both the head of the threaded fastener 1038, the hub 1080 of the fan 1034, and the hub portion 1060 of the motor pulley 1032. Accordingly, it will be appreciated that a first portion of the clamping force that is generated by the threaded fastener 1038 can be transmitted directly to the motor pulley 1032 and that a second portion of the clamping force that is generated by the threaded fastener 1038 can be transmitted to the hub 1080 of the fan 1034 to secure the fan 1034 to the motor pulley 1032. Advantageously, the outer periphery of the Belleville washer 1036 is spring-like in nature so as to maintain a desired clamping force on the fan 1034 despite changes in the thickness of the hub 1080 of the fan 1034 due to creep.

Those of skill in the art will appreciate from this disclosure that the rotational centerlines of the crankshaft 150 and the output shaft 1042 of the electric motor 1030 can be maintained at a desired spacing by virtue of the configuration of the rear cover 90*a* and also that the axial positions of the driven pulley 158 and the motor pulley 1032 can be maintained at a desired relationship by virtue of the size and location of the various tapered surfaces on the crankshaft 150, the driven pulley 158, the output shaft 1042 and the motor pulley 1032. Accordingly, a fan belt 1090, such as a "stretch-belt", can be employed to transmit rotary power from the electric motor 1030 to the crankshaft 150. The fan belt 1090 can be fitted to the motor pulley 1032 and the driven pulley 158 and the motor pulley 1032 and the driven pulley 158 can be installed simultaneously to the electric motor 1030 and the crankshaft 150, respectively. The tapered end 1054 and the mating tapered portion 1072 can cooperate to align the rotational axis of the motor pulley 1032 to the rotational axis of the output shaft 1042 as the motor pulley 1032 is being installed to the output shaft 1042. Similarly, the tapered segment 180 and the mating tapered portion 218 can cooperate to align the rotational axis of the driven pulley 158 to the rotational axis of the crankshaft 150. The combination of the simultaneous installation of the motor pulley 1032 and the driven pulley 158 with the fan belt 1090 preinstalled to the motor pulley 1032 and the driven pulley 158 along with the mating tapers between the shafts (tapered end 1054 and tapered segment 180) and the pulleys (motor pulley 1032 and driven pulley 158) permits the fan belt 1090 to be stretched as the pulleys are being installed.

A belt guard 1100 can be mounted to the rear cover 90*a* to shroud the belt 1090. The belt guard 1100 can further be employed to direct the air flow generated by the fan 1034 toward the rear cover 90*a* and/or the block 50*a* in a manner that is similar to that which is described in U.S. patent application Ser. No. 11/047,521 entitled "Cooling Arrangement for a Portable Air Compressor", the disclosure of which is hereby incorporated by reference as if fully set forth in detail herein. Moreover, the belt guard 1100 can include a cavity 1102 and a cover 1104 can be snap-fit to the belt guard 1100 to close the cavity 1102. A seal (not shown) can be disposed between the belt guard 1100 and the cover 1104 to inhibit dirt and moisture from entering the cavity 1102. The cavity 1102 can be sized to receive an owner's manual (not shown) and/or a tool kit (not shown) for use in servicing the air compressor system 10*a*.

In the example provided, the filter system 520*a* can also comprise an inlet tube 1200 that is coupled in fluid connection to the low pressure cavities 580*a* of the heads 512*a*. The filter system 520*a* can be constructed and operated as described in U.S. Pat. No. 5,137,434 entitled "Universal Motor Oilless Air Compressor", the disclosure of which is hereby incorporated by reference as if fully set forth in detail herein. The distal end 1204 of the inlet tube 1200 is disposed in the flow path of the air that is discharged from the fan 1034 in a direction that is transverse to the flow path. The distal end 1204 may be crimped or crushed to a desired degree to inhibit the entry of relatively large particles or debris into the inlet tube 1200. Dirt and debris contained in the air in the flow path can travel at a relatively high speed past the distal end 1204 of the inlet tube 1200 and as such, their momentum reduces the likelihood that they will be drawn into the distal end 1204 of the inlet tube 1200 as the air compressor system 10*a* operates.

While specific examples have been described in the specification and illustrated in the drawings, it will be understood by those of ordinary skill in the art that various changes may be made and equivalents may be substituted for elements thereof without departing from the scope of the present disclosure as defined in the claims. Furthermore, the mixing and matching of features, elements and/or functions between various examples is expressly contemplated herein so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out the teachings of the present disclosure, but that the scope of the present disclosure will include any embodiments falling within the foregoing description and the appended claims.

What is claimed is:

1. An air compressor assembly comprising:

a cylinder block group having a head deck, the cylinder block group defining an internal cavity, at least a portion of the interior cavity forming a sump, the sump being configured to receive a lubricant such that the lubricant is disposed below a liquid lubricant fill level;

a crankshaft rotatably disposed in the interior cavity;

a piston kit group having a cylinder and a piston kit, the cylinder being received through the head deck and defining a piston bore, at least one cooling channel being formed about an exterior surface of the cylinder, the piston kit including a piston, a wrist pin and a connecting rod, the piston being slidably received in the piston bore, the wrist pin connecting the piston to a first end of the connecting rod, a second end of the connecting rod being coupled to the crankshaft; and a member associated with the crankshaft, the member moving in the sump such that at least a portion of the member crosses the liquid lubricant fill level as the crankshaft rotates, the member being adapted to sling the lubricant outwardly from the sump such that a first portion of the slung lubricant collects on at least one of the piston bore and the piston to lubricate an interface between the piston and the cylinder and a second portion of the slung lubricant collects in the at least one cooling channel and moves at least partially around the exterior surface of the cylinder in response to gravitational force exerted thereon to thereby draw heat from the cylinder;

wherein the air compressor assembly does not include a lubricant pump for pumping the lubricant to lubricate the piston group and the crankshaft.

2. The air compressor assembly of claim 1, wherein the at least one cooling channel is formed in a helical manner.

3. The air compressor assembly of claim 2, wherein the helix of the at least one cooling channel has an axis that is coincident with a longitudinal axis of the piston bore.

4. The air compressor assembly of claim 2, wherein the helix of the at least one cooling channel has an axis that is transverse to a longitudinal axis of the piston bore.

5. The air compressor assembly of claim 2, wherein the at least one flow channel is formed into the exterior surface along a tooling axis that is oriented transverse to an axis of a helix of the at least one cooling channel.

6. The air compressor assembly of claim 1, wherein the cylinder includes a cylinder body and a cylinder flange that extends radially outwardly from the cylinder body, the cylinder flange being received in a counterbore formed in the head deck.

7. The air compressor assembly of claim 6, wherein the at least one flow channel is formed into the exterior surface along a tooling axis that is generally perpendicular to an axis of a helix of the at least one cooling channel.

8. The air compressor assembly of claim 6, wherein a chamfer is formed into the cylinder body on an end of the cylinder body opposite the cylinder flange, the chamfer intersecting the piston bore.

9. The air compressor assembly of claim 1, wherein the member includes a counterweight portion of the crankshaft.

10. The air compressor assembly of claim 1, wherein the member is sized so that at least a portion of the member is disposed in the lubricant in the sump regardless of a rotational position of the crankshaft.

11. The air compressor assembly of claim 1, further comprising a cylinder sleeve cover that is engaged to the cylinder, the cylinder sleeve cover at least partially covering at least a portion of the exterior of the cylinder.

12. The air compressor assembly of claim 1, wherein the air compressor assembly has an operating orientation and the piston reciprocates along a vertical piston axis.

13. The air compressor assembly of claim 1, wherein the air compressor assembly has an operating orientation and the piston reciprocates along an axis that is transverse to a vertical axis.

14. The air compressor assembly of claim 1, wherein the at least one cooling channel is formed with a plurality of cross-hatched grooves, a plurality of parallel grooves extending parallel to an axis along which the piston reciprocates, a plurality of grooves extending transverse to the axis along which the piston reciprocates or a combination of at least two thereof.

15. An air compressor assembly comprising:

a cylinder block group having a head deck, the cylinder block group defining an internal cavity, at least a portion of the interior cavity forming a sump;

a crankshaft rotatably disposed in the interior cavity;

a lubricant disposed in the sump;

a piston kit group having a cylinder and a piston kit, the cylinder being received through the head deck and defining a piston bore, the piston kit including a piston, a wrist pin and a connecting rod, the piston being slidably received in the piston bore, the wrist pin connecting the piston to a first end of the connecting rod, a second end of the connecting rod being coupled to the crankshaft; and a member associated with the crankshaft, the member moving through the lubricant in the sump to thereby sling the lubricant outwardly from the sump such that a first portion of the slung lubricant collects on at least one of the piston bore and the piston to lubricate an interface between the piston and the cylinder and a second portion of the slung lubricant draws heat from the cylinder from a surface other than the piston bore;

wherein the cylinder is configured to collect the second portion of the slung lubricant and control the flow of the second portion of the slung lubricant as it drains back to the sump.

16. The air compressor of claim 15, wherein at least one flow channel is formed on an exterior surface of the cylinder.

17. The air compressor of claim 16, wherein at least a portion of the at least one flow channel is helically shaped.

18. The air compressor of claim 17, wherein a helix of the at least the portion of the at least one cooling channel has an axis that is coincident with a longitudinal axis of the piston bore.

19. The air compressor of claim 17, wherein the at least one flow channel is formed into the exterior surface at a direction that is transverse to an axis of a helix of the at least one cooling channel.

20. The air compressor of claim 16, wherein the at least one flow channel is formed into the exterior surface generally perpendicular to the axis of the helix of the at least one cooling channel.

21. The air compressor of claim 15, wherein at least one flow channel is integrally formed with a remainder of the cylinder.

22. The air compressor of claim 15, further comprising a cylinder sleeve cover that is engaged to the cylinder, the cylinder sleeve cover at least partially covering at least a portion of the exterior of the cylinder.

23. A method for rejecting heat from an air compressor, the air compressor comprising a cylinder block group, a crankshaft, a lubricant and a piston kit, the cylinder block group having a head deck and defining an internal cavity, at least a portion of the interior cavity forming a sump, the crankshaft being rotatably disposed in the interior cavity, the lubricant being disposed in the sump, the piston kit group having a cylinder and a piston kit, the cylinder being received through the head deck and defining a piston bore, the piston kit including a piston, a wrist pin and a connecting rod, the piston being slidably received in the piston bore, the wrist pin connecting the piston to a first end of the connecting rod, a second end of the connecting rod being coupled to the crankshaft, the method comprising:

rotating the crankshaft to reciprocate the piston in the cylinder to alternately intake air into the cylinder and compress the air, wherein rotation of the crankshaft moves a member associated with the crankshaft through the lubricant in the sump such that the member slings lubricant outwardly;

discharging the compressed air from the cylinder;

collecting a portion of the slung lubricant on an exterior surface of the cylinder; and directing the collected portion of the slung lubricant to flow about the exterior surface in a predetermined manner to permit heat to be rejected from the cylinder to the collected portion of the slung lubricant.

24. An air compressor assembly comprising:

a crankcase including a head deck and defining an internal cavity, at least a portion of the interior cavity forming a sump;

a crankshaft rotatably disposed in the interior cavity;

a lubricant disposed in the sump;

a compression cylinder including an exterior surface principally surrounded by the internal cavity and an inner surface defining a piston bore;

a piston kit including a piston, a wrist pin and a connecting rod, the piston being slidably received in the piston bore, the wrist pin connecting the piston to a first end of the connecting rod, a second end of the connecting rod being coupled to the crankshaft; and a head assembly coupled to the crankcase, the head assembly including an outlet valve;

wherein the piston reciprocates in the cylinder to compress air that is disposed between the compression cylinder, the piston and the head assembly and wherein the valve opens to release compressed air in the compression cylinder when a pressure of the compressed air in the compression cylinder exceeds a predetermined pressure.

25. The air compressor assembly of claim 24, wherein the compression cylinder is received through the head deck and is suspended from the head deck within the internal cavity.

26. The air compressor assembly of claim 25, wherein the cylinder includes a cylinder body and a cylinder flange that extends radially outwardly from the cylinder body, the cylinder flange being received in a counterbore formed in the head deck.

27. The air compressor assembly of claim 24, wherein the compression cylinder includes a cooling channel substantially surrounding the exterior surface.

28. The air compressor assembly of claim 27, wherein the cooling channel is formed in a helical path around the compression cylinder exterior surface.

29. The air compressor assembly of claim 27, further comprising a jacket substantially surrounding the exterior surface of the compression cylinder and the cooling channel is located between the exterior surface and the jacket.

30. The air compressor assembly of claim 24, and further comprising a slinger associated with the crankshaft, the slinger moving through the lubricant in the sump and slinging the lubricant inside the interior cavity, a first portion of the slung lubricant collecting on at least one of the internal surface of the compression cylinder and the piston to lubricate an interface between the piston and the cylinder, a second portion of the slung lubricant collecting in the cooling channel, the second portion of the slung lubricant moving about the exterior surface of the cylinder in response to gravitational force exerted thereon to thereby draw heat from the cylinder.

* * * * *

UNITED STATES PATENT AND TRADEMARK OFFICE

CERTIFICATE OF CORRECTION

PATENT NO. : 7,765,917 B2
APPLICATION NO. : 11/960859
DATED : August 3, 2010
INVENTOR(S) : John W. Hardin et al.

It is certified that error appears in the above-identified patent and that said Letters Patent is hereby corrected as shown below:

Column 19,
line 8, “interior” should be -- internal --.
line 11, “interior” should be -- internal --.

Column 20,
line 22, “interior” should be -- internal --.
line 23, “interior” should be -- internal --.

Column 21,
line 5, “interior” should be -- internal --.
line 6, “interior” should be -- internal --.
line 31, “interior” should be -- internal--.
line 33, “interior” should be -- internal --.

Column 22,
line 32, “interior” should be -- internal --.

Signed and Sealed this

Ninth Day of November, 2010

David J. Kappos

David J. Kappos
*Director of the United States Patent and Trademark Office*